US011594803B2

(12) United States Patent
Gierow et al.

(10) Patent No.: US 11,594,803 B2
(45) Date of Patent: Feb. 28, 2023

(54) TACTICAL SUPPORT STRUCTURE FOR TRACKING SPHERICAL SATELLITE ANTENNA

(71) Applicant: Cubic Corporation, San Diego, CA (US)

(72) Inventors: Paul Gierow, Ardmore, TN (US); William Clayton, Madison, AL (US); Scott Borchers, Brownsboro, AL (US)

(73) Assignee: Cubic Corporation, Sand Diego, CA (US)

( * ) Notice: Subject to any disclaimer, the term of this patent is extended or adjusted under 35 U.S.C. 154(b) by 0 days.

(21) Appl. No.: 17/239,014

(22) Filed: Apr. 23, 2021

(65) Prior Publication Data

US 2021/0336321 A1 Oct. 28, 2021

Related U.S. Application Data

(60) Provisional application No. 63/018,949, filed on May 1, 2020, provisional application No. 63/014,581, filed on Apr. 23, 2020, provisional application No. 63/014,575, filed on Apr. 23, 2020, provisional application No. 63/014,584, filed on Apr. 23, 2020.

(51) Int. Cl.

| | |
|---|---|
| ***H01Q 1/08*** | (2006.01) |
| ***H01Q 1/42*** | (2006.01) |
| ***H01Q 15/16*** | (2006.01) |
| ***H01Q 3/08*** | (2006.01) |
| *H01Q 1/20* | (2006.01) |

(52) U.S. Cl.

CPC ..... *H01Q 1/081* (2013.01); *H01Q 1/082* (2013.01); *H01Q 1/428* (2013.01); *H01Q 3/08* (2013.01); *H01Q 15/163* (2013.01); *H01Q 1/20* (2013.01)

(58) Field of Classification Search

CPC ..... H01Q 1/081; H01Q 1/082; H01Q 3/08; H01Q 1/125; H01Q 1/1257; H01Q 1/1264; H01Q 1/428; H01Q 15/163

See application file for complete search history.

(56) References Cited

U.S. PATENT DOCUMENTS 3,045,952 A * 7/1962 Underwood ..... H01Q 1/1292 244/33
3,075,191 A * 1/1963 Peay ..... H01Q 1/428 52/114
3,313,502 A * 4/1967 Menahem ..... H01Q 3/08 211/1.51

(Continued)

*Primary Examiner* — Ab Salam Alkassim, Jr.

(74) *Attorney, Agent, or Firm* — Mughal IP P.C.

(57) ABSTRACT

An inflatable tracking antenna assembly may include an inflatable antenna. The inflatable antenna may be configurable in a packed configuration and a deployed configuration. In the deployed configuration the inflatable antenna may be generally spherical in shape. The assembly may include an antenna support structure. The support structure may include a plurality of support arms that couple with lateral sides of the inflatable antenna. The support structure may include a base that is coupled with each of the plurality of support arms. The base may include an azimuth actuator that adjusts an azimuth position of the inflatable antenna and an elevation actuator that adjusts an elevation angle of the inflatable antenna. The support structure may include a plurality of support legs that extend outward from the base.

18 Claims, 21 Drawing Sheets

(56) References Cited

U.S. PATENT DOCUMENTS 6,023,247 A * 2/2000 Rodeffer ..... H01Q 1/3275 343/765
6,188,367 B1 * 2/2001 Morrison ..... H01Q 1/125 343/757
6,266,029 B1 * 7/2001 Lee ..... H01Q 25/007 343/757
6,329,956 B1 * 12/2001 Tateishi ..... H01Q 3/08 343/753
6,963,315 B2 * 11/2005 Gierow ..... H01Q 1/081 343/872
7,764,243 B2 7/2010 Gierow et al.
9,263,797 B1 * 2/2016 Hall ..... H01Q 3/02
9,570,794 B2 * 2/2017 Clayton ..... H01Q 19/13
10,122,092 B2 11/2018 Clayton et al.
2008/0042921 A1 * 2/2008 Gierow ..... H01Q 1/082 343/882
2009/0158878 A1 * 6/2009 Clayton ..... H01Q 1/081 74/479.01
2009/0237303 A1 * 9/2009 Sohfuku ..... H01Q 1/125 342/359
2009/0238668 A1 * 9/2009 Grange ..... H01Q 3/02 343/765
2009/0243955 A1 * 10/2009 Legare ..... H01Q 1/08 343/882
2010/0018595 A1 * 1/2010 Clayton ..... H01Q 1/081 137/565.13
2014/0070993 A1 * 3/2014 Hopkins ..... H01Q 3/08 342/359
2014/0266969 A1 * 9/2014 Clayton ..... H01Q 19/13 343/878
2014/0266970 A1 * 9/2014 Clayton ..... H01Q 15/163 343/881
2019/0123418 A1 * 4/2019 Sherwood ..... H01Q 1/125
2020/0313293 A1 * 10/2020 Morita ..... H02J 50/10
2021/0249767 A1 * 8/2021 Greenwood ..... H01Q 25/00

* cited by examiner

300

TACTICAL SUPPORT STRUCTURE FOR TRACKING SPHERICAL SATELLITE ANTENNA

CROSS-REFERENCES TO RELATED APPLICATIONS

This application claims the benefit of and is a non-provisional of U.S. Provisional Application Ser. Nos. 63/014,575, 63/014,581, and 63/014,584, all filed on Apr. 23, 2020, and U.S. Provisional Application Ser. No. 63/018,949, filed May 1, 2020, which are hereby expressly incorporated by reference in their entireties for all purposes.

BACKGROUND OF THE INVENTION

Transport of radio wave systems that use some form of electromagnetic reflecting antenna, i.e., radar or communications, is cumbersome, partially because of the antenna. To address these issues, inflatable antennas have often been used. However, due to limitations in the weight and packability of support structure components, these inflatable antennas are typically only used in conjunction with geostationary and/or geosynchronous satellite systems. Therefore, improvements are desired for providing packable support structures for inflatable antennas that may track satellites in a greater array of orbital patterns.

BRIEF SUMMARY OF THE INVENTION

In one embodiment, an inflatable tracking antenna assembly is provided. The inflatable tracking antenna assembly may include an inflatable antenna. The inflatable antenna may be configurable in a packed configuration and a deployed configuration. In the deployed configuration the inflatable antenna may be generally spherical in shape. The assembly may include an antenna support structure. The support structure may include a plurality of support arms that couple with lateral sides of the inflatable antenna. The support structure may include a base that is coupled with each of the plurality of support arms. The base may include an azimuth actuator that adjusts an azimuth position of the inflatable antenna and an elevation actuator that adjusts an elevation angle of the inflatable antenna. The support structure may include a plurality of support legs that extend outward from the base.

In some embodiments, the inflatable antenna may include at least two mating features. Each of the at least two mating features may be disposed on a lateral side surface of the inflatable antenna. A top end of each of the plurality of support arms may include a corresponding mating feature that is engageable with a respective one of the at least two first mating features of the inflatable antenna. An electrical connection between the base and the inflatable antenna may be provided via engagement of the at least two mating features and the corresponding mating features. The assembly may include a timing belt coupled with the inflatable antenna and the elevation actuator. The elevation actuator may maneuver the timing belt to adjust the elevation angle of the inflatable antenna. The base may include a stationary portion and a rotatable portion disposed atop the stationary portion. The azimuth actuator may rotate the rotatable portion relative to the stationary portion to adjust the azimuth position of the inflatable antenna. The assembly may include a slip ring disposed between the stationary portion and the rotatable portion. The slip ring may facilitate communication of electrical signals between the stationary portion and the rotatable portion. Each of the plurality of support arms and each of the plurality of support legs may be engageable and disengageable with the base without use of any tools.

In another embodiment, a tracking support structure for an inflatable antenna is provided. The support structure may include a plurality of support arms that couple with lateral sides of the inflatable antenna. The support structure may include a base that is coupled with each of the plurality of support arms. The base may include a stationary portion. The base may include a rotatable portion disposed atop the stationary portion. The base may include an azimuth actuator rotates that rotatable portion relative to the stationary portion to adjust an azimuth position of the inflatable antenna. The base may include an elevation actuator that adjusts an elevation angle of the inflatable antenna. The support structure may include a plurality of support legs that extend outward from the base.

In some embodiments, each of the plurality of support arms may be packable into a smaller form factor when the tracking base is disassembled. Each of the plurality of support arms may be formed from multiple segments. The segments may be permanently coupled with and foldable relative to one another. At least some of the multiple segments may be generally linear. The multiple segments may be fully separable from one another. The support structure may include a slip ring disposed between the stationary portion and the rotatable portion, the slip ring that may facilitate communication of electrical signals between the stationary portion and the rotatable portion.

In another embodiment, a tracking support structure for an inflatable antenna may include a plurality of support arms that couple with lateral sides of the inflatable antenna. That support structure may include a base that is coupled with each of the plurality of support arms. The base may include a stationary portion. The base may include a rotatable portion disposed atop the stationary portion. The base may include an azimuth actuator rotates that rotatable portion relative to the stationary portion to adjust an azimuth position of the inflatable antenna. The base may include an elevation actuator that adjusts an elevation angle of the inflatable antenna.

In some embodiments, each of the plurality of support arms may be curved. The support structure may include one or more rollers disposed on an upward facing surface of one or both of the base and one or more of the plurality of support arms. The support structure may include a plurality of support legs that extend outward from the base. Each of the plurality of support legs may include a leveling support. A top end of each of the plurality of support arms may include mating features that are engageable with corresponding mating features of the inflatable antenna. The tracking support structure may be packable into one or more handheld storage containers between deployments.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a set of parentheses containing a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to support structures for an inflatable antenna that are able to adjust the elevation and azimuth position of the antenna, enabling the antenna to track Low Earth Orbit (LEO) and/or Mid Earth Orbit (MEO) satellites and/or be auto-pointed at a Geosynchronous Equatorial Orbit (GEO) satellite. Tracking satellite antennas may require the antenna to move in multiple axes to follow an object that moves relative to the antenna. The support structures described herein may contain provisions that enable the antenna to be mounted to the ground or other mounting surface, mounting points for power and control electronics, drive motors, sensors, RF equipment and the antenna.

Embodiments provide support structures that may be assembled and disassembled quickly, while providing adequate structural rigidity to support a satellite antenna while tracking and/or otherwise be pointed at a given satellite. Embodiments may enable the antenna and support structure to be transported quickly and easily. For example, the antenna and support structure may be lightweight and may be quickly broken into pieces that can be placed in transit cases. During setup, the various pieces of the antenna and support structure may be assembled quickly without tools and may provide interfaces for the antenna to be attached to the ground with ballast or stakes and/or otherwise stabilized. The support structure may include provisions to level the antenna in uneven terrain.

Figure 1A:
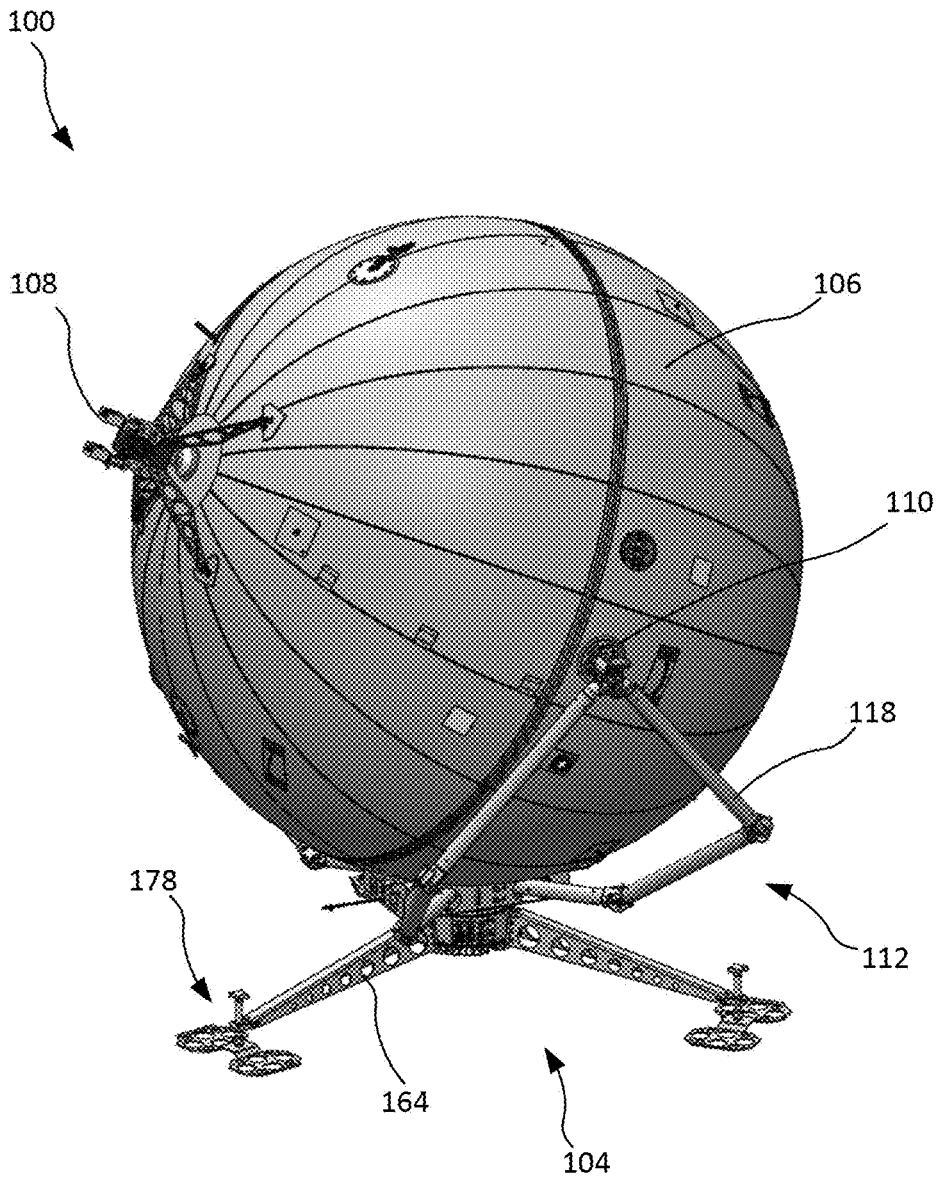
FIG. 1A illustrates an inflatable tracking antenna assembly according to an embodiment of the present invention.

Turning now to FIG. 1A, one embodiment of an inflatable tracking antenna assembly 100 is illustrated. Assembly 100 may include an inflatable antenna 102, which may be positioned atop an antenna support structure 104. The antenna 102 may include a spherical inflatable shell 106 that includes a membrane (not shown) that is positioned within the interior of the shell 105 roughly disposed at or proximate the interior equator. The membrane may form a parabolic and/or lenticular reflector (not shown) that is coupled with a feed horn assembly 108 mounted in a surface of the shell 106. The feed horn assembly 108 may be positioned on the outside surface of the shell 106 and may be located roughly at the focal point of the parabola created by the membrane. The membrane may have an electromagnetic reflective surface oriented toward the feed horn assembly 108 such that the inflatable antenna 102 may function as parabolic antennas currently known in the art. The antenna 102 may include one or more differential GPS connections 110, which may be positioned on lateral sides of the antenna. The differential GPS connections 110 may enable the antenna 102 to be physically and/or communicatively coupled with the support structure 104 as will be discussed in greater detail below. The antenna 102 may include and/or be coupled with a blower and/or other inflation device that may be used to inflate the antenna 102 into a deployed configuration. The antenna 102 may be deflated to a packed configuration. For example, the deflated antenna 102 may be folded and/or otherwise packed into a travel case for storage and/or transport. Examples of such inflatable antenna apparatuses may be found, for example, in U.S. Pat. Nos. 6,963,315, 9,570,794, and 10,122,092, the entire contents of which are incorporated by reference herein.

Some solutions for supporting dish shaped antennas that required significantly larger structure for a similar antenna aperture due to having high wind loads and antenna weights. The use of a spherical inflatable antenna allows for lighter weight structure due to lower wind loads and a lighter antenna. Other pointing mechanisms/structures are not easy assembled or disassembled and required days to put together to ensure that the antenna is functioning as desired. U.S. Pat. No. 7,764,243 describes an antenna positioning system for a spherical antenna, which is hereby incorporated by reference for all purposes. The antenna support structure 104 may include a number of support arms 112 that may support the antenna 102 atop the support structure 104. Any number of support arms 112 may be used, include a single support arm 112. Some or all of the support arms 112 may couple with lateral sides of the inflatable antenna 102. For example, a top end 114 of each of the support arms 112 may include a mating feature 116 that is engageable with a respective mating feature (such as the differential GPS connection 110) of the inflatable antenna 102. The mating features 116 may be rotatable relative to the support arms 112 and/or antenna 102, which may enable an elevation angle of the antenna 102 to be adjusted relative to the support arms 112 without changing a position of the support arms 112 or disengaging the antenna 102 from the mating features 116. In some embodiments, the engagement of the respective mating features of the antenna 102 and the support arms 112 may not only physically couple the antenna 102 and support structure 104, but may also communicatively coupled the two components. For example, position information (such as GPS coordinates) and/or satellite communications signals may be relayed to the base 128 via the differential GPS connection 110.

Figure 1B:
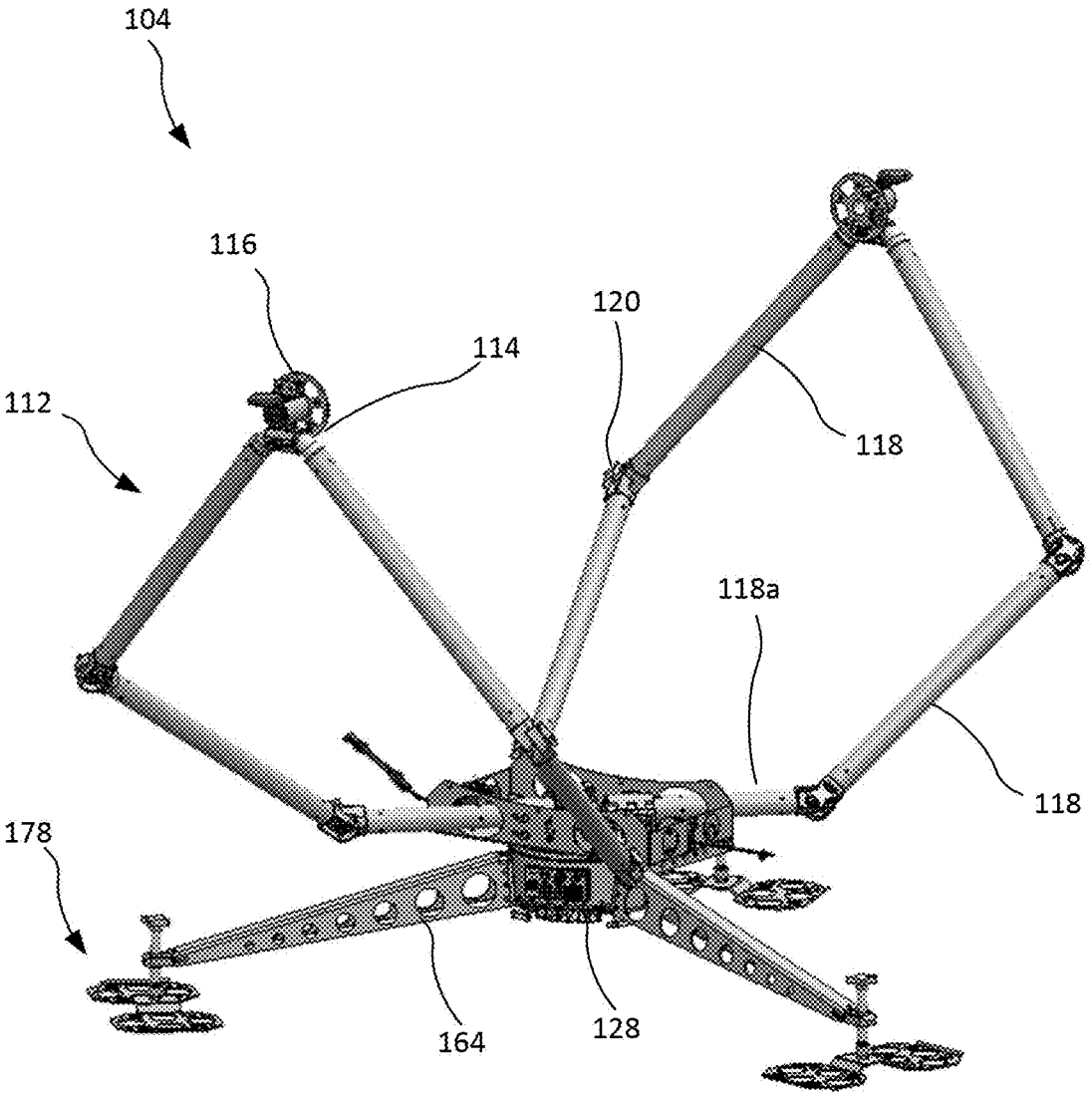
FIG. 1B illustrates an antenna support structure according to an embodiment of the present invention.
Figure 1C:
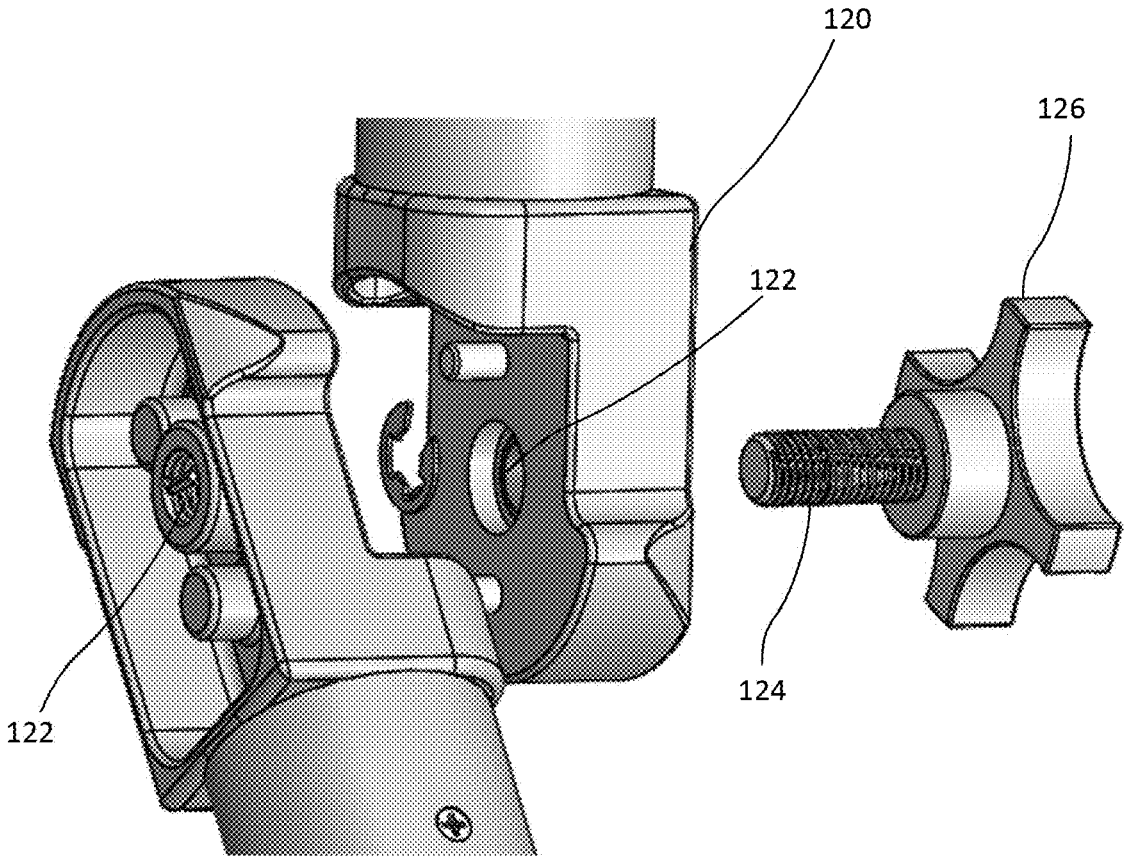
FIG. 1C illustrates a number of attachment points of an antenna support structure according to an embodiment of the present invention.

As best illustrated in FIG. 1B, each of the support arms 112 may extend upward and outward from a base 128 of the support structure 104. In some embodiments some or all of the support arms 112 may be formed from a single piece, while in other embodiments some or all of the support arms 112 may be formed from a number of packable segments 118. Any number of segments 118 may be utilized to form each support arm 112. The segments 118 may each be identical and/or some or all of the segments 118 may have unique designs. The segments 118 may be straight and/or curved to create a straight and/or curved support arm 112. As illustrated, each support arm 112 may include two horizontal segments 118*a* that couple with the base 128 to form two sides of each support 112. two angled segments 118*b* are coupled with each horizontal segment 118*a* and join at or proximate the top end 114 of the support arm 112. Each of the segments 118 may be separable, foldable, and/or otherwise packable into a smaller form factor for storage and transport of the support structure 104. For example, ends of each segment 118 may include attachment points 120 that enable the segments 118 to be coupled with another. As illustrated in FIG. 1C, the attachment points 120 may enable tool-less coupling of the various segments 118. For example, each attachment point 120 may include a threaded aperture 122 that may receive a threaded fastener 124, which may be coupled with a human-graspable feature, such as a knob 126. The apertures 122 of attachment points 120 of different segments 118 may be aligned and the threaded fastener 124 may be inserted through each aperture 122 to secure the segments 118 together. In some embodiments, the attachment points 120 may enable angles formed between adjacent segments 118 to be adjusted, while in other embodiments, the attachment points 120 may fix the relative angle of each segment 118. For example, each attachment point 120 may have a geometry, such as a locking notch, that only enables the segments 118 to be coupled in a singular angular orientation. While described with threaded connections, it will be appreciated that other tool-less interfaces may be provided. For example, the segments 118 may be coupled with clamps, magnets, and/or other known fasteners. In some embodiments, rather than being separable, the segments 118 may be foldable. For example, the segments 118 may include elastic cables within the interior of the segments 118 that enable the segments 118 to be assembled and/or disassembled like tent poles. In other embodiments, the segments 118 may be coupled with one another via one or more hinges, which enable the support arm 112 to be folded up. The hinges may include locking mechanisms that may be engaged to lock the support arms 112 in a deployed and/or packed state.

Figure 1D:
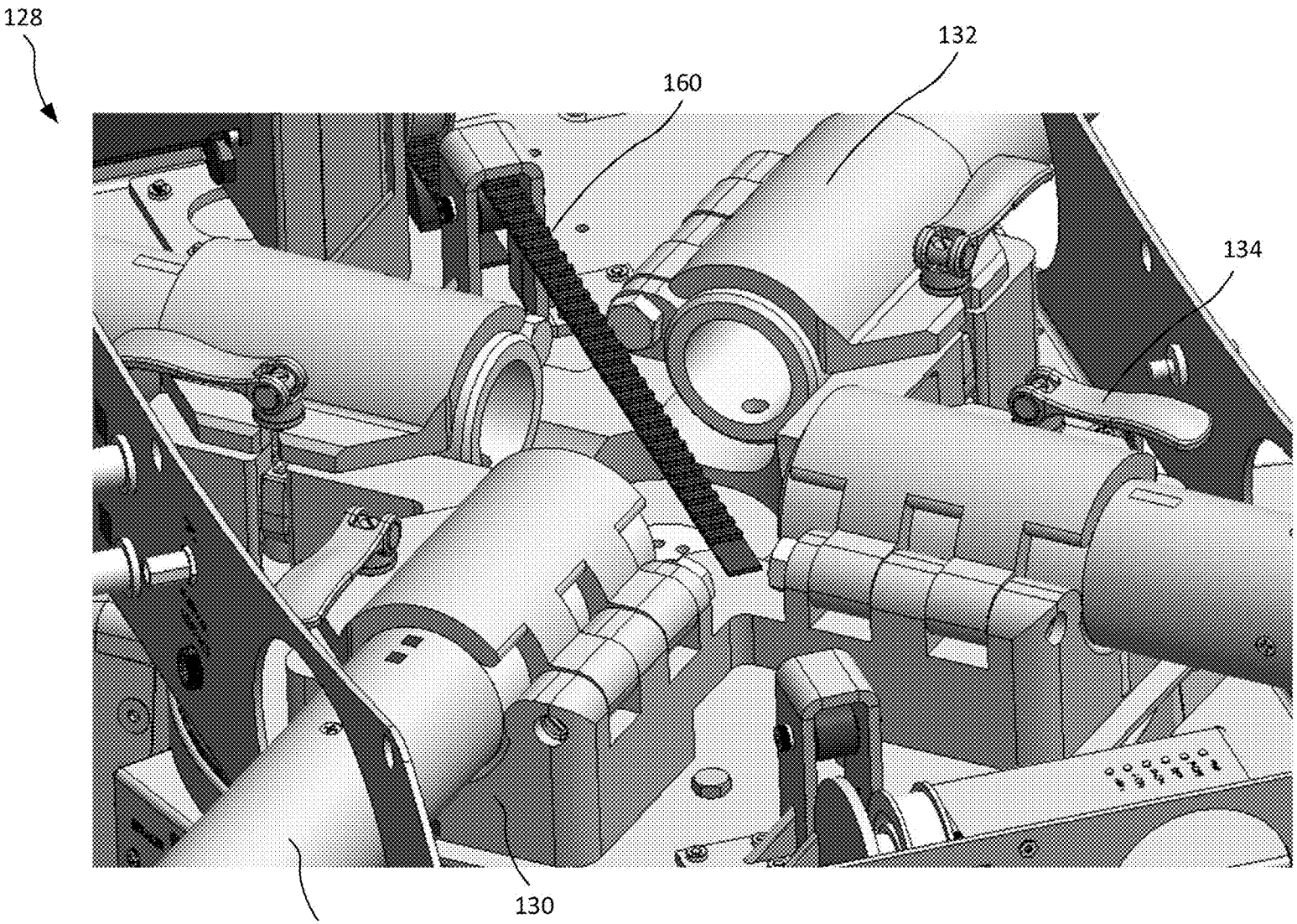
FIG. 1D illustrates a coupling system of an antenna support structure according to an embodiment of the present invention.

As indicated above, the support arms 112 may be coupled with the base 128. FIG. 1D illustrates one embodiment of a coupling system for securing the support arms 112 to the base 128. For example, the base 128 may include one or more receptacles 130 for each support arm 112 and/or each lowermost segment 118 (such as horizontal segment 118*a*). An end of each support arm 112 and/or each lowermost segment 118 may be inserted within a respective receptacle 130. A cover 132 may be positioned over the respective end of the support arm 112 and/or lowermost segment 118, and the cover 132 may be secured in a closed position to lock the respective support arm 112 and/or lowermost segment 118 within the receptacle 130. For example, a fastener and/or clamp, such as a cam clamp 134, may be used to lock the cover 132 against the receptacle 130. It will be appreciated that other tool-less connections between the support arms 112 and base 128 may be utilized, such as pinned connections, threaded connections, and the like.

Figure 1E:
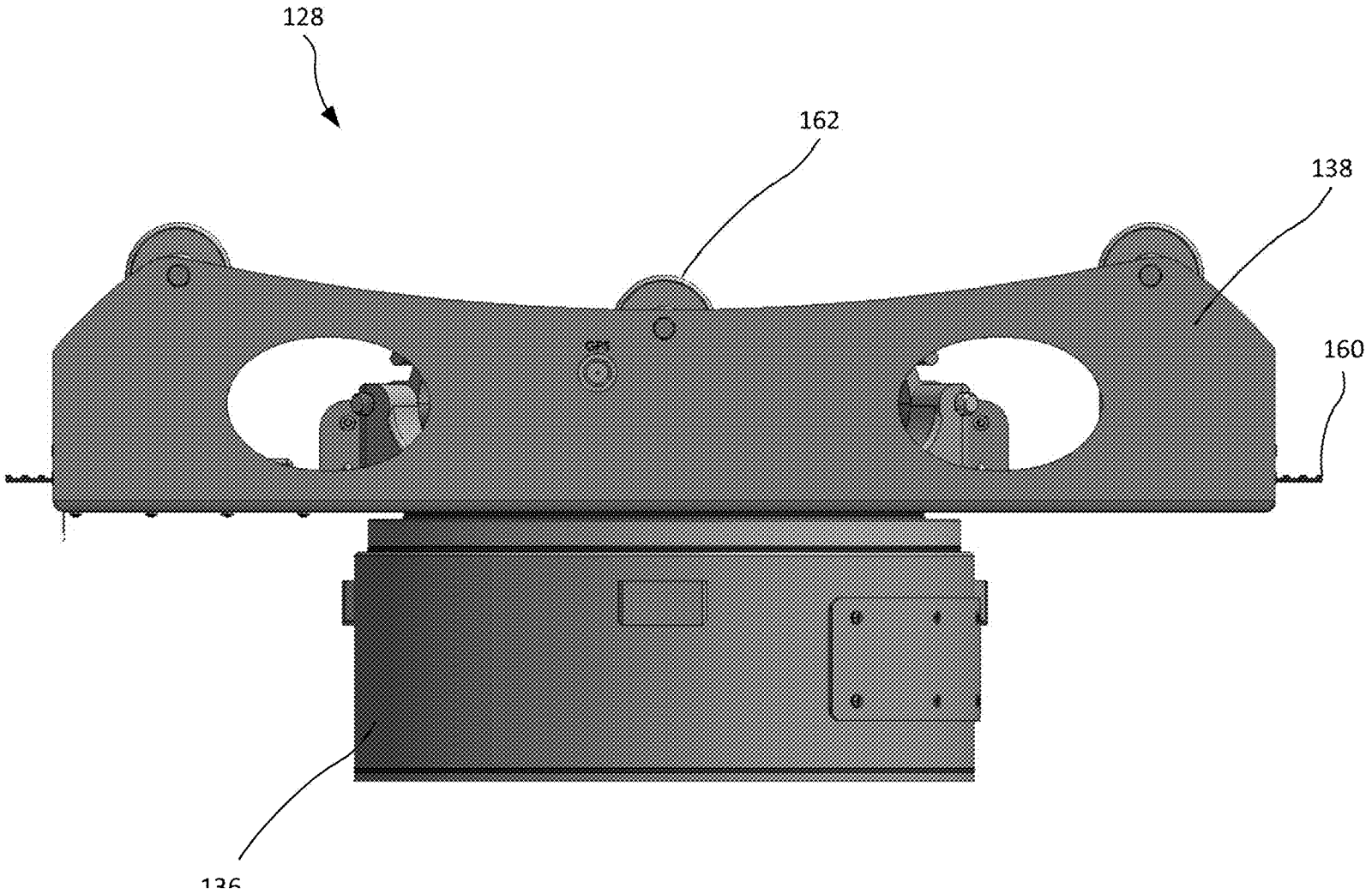
FIG. 1E illustrates a base of an antenna support structure according to an embodiment of the present invention.
Figure 1F:
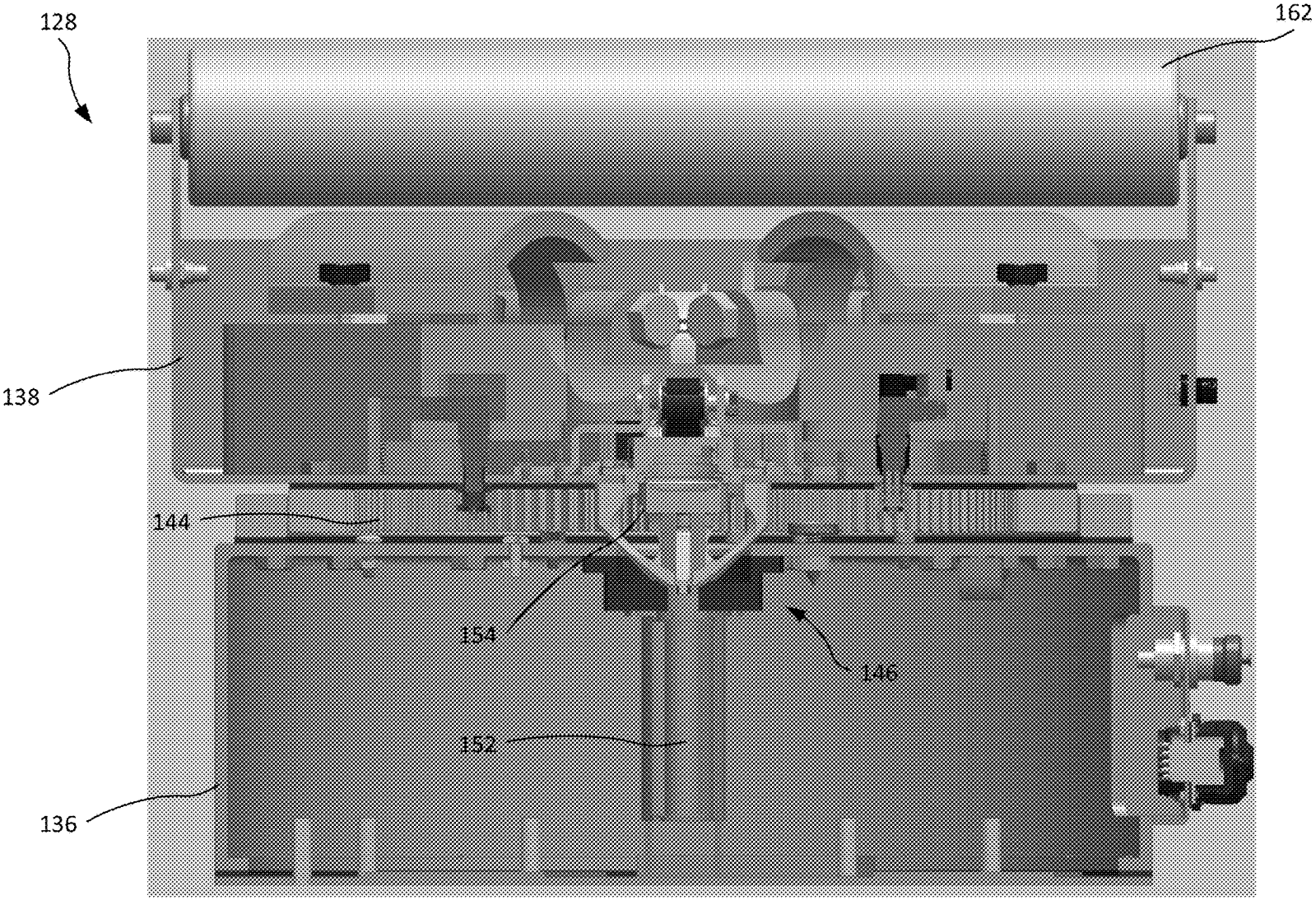
FIG. 1F illustrates a base of an antenna support structure according to an embodiment of the present invention.
Figure 1G:
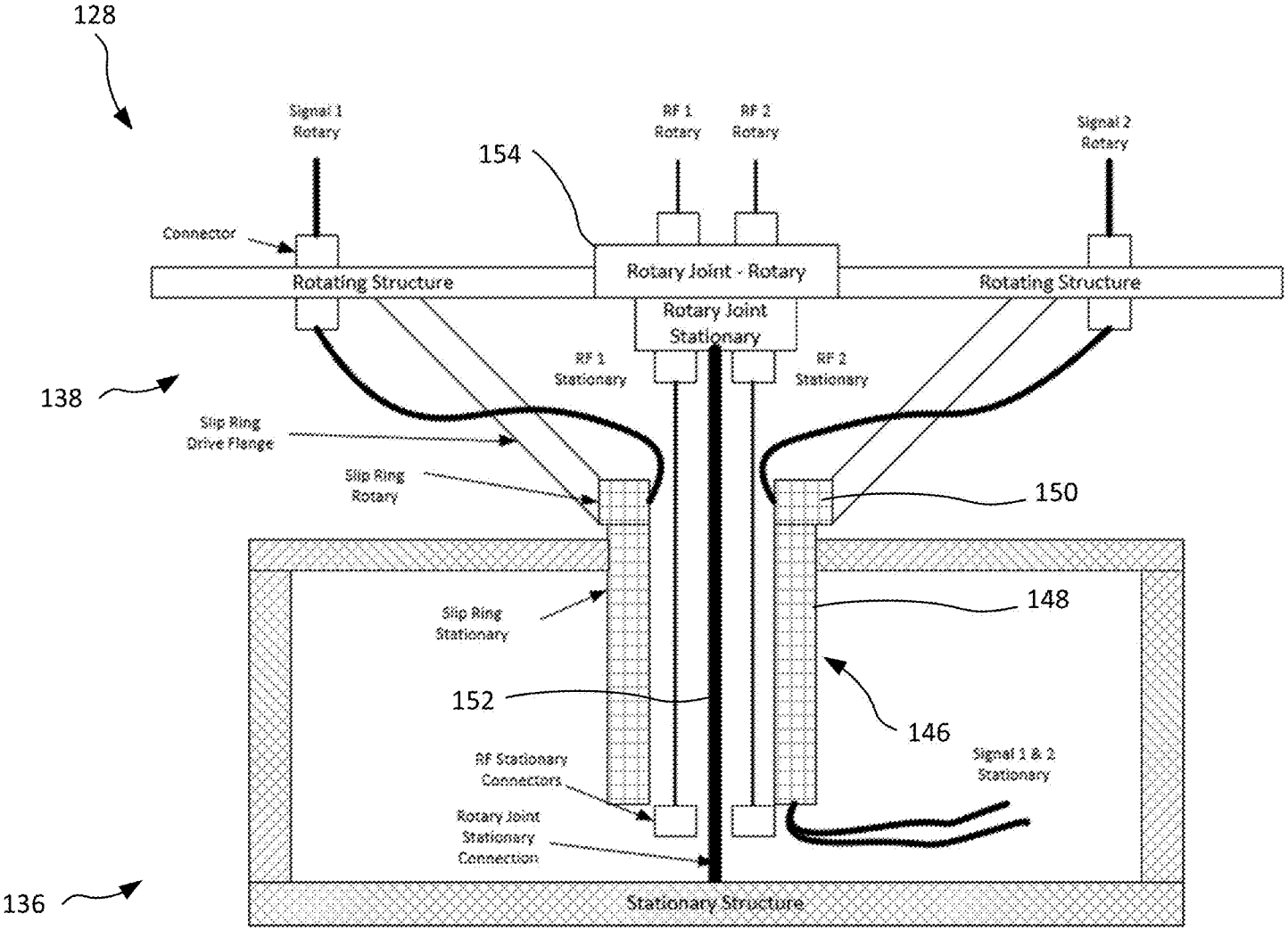
FIG. 1G illustrates a base of an antenna support structure according to an embodiment of the present invention.

As illustrated in FIGS. 1E-1G, base 128 may include a stationary portion 136 and a rotatable portion 138 that is coupled with the stationary portion 136 and is able to rotate relative to the stationary portion 136. For example, the rotatable portion 138 may be positioned atop the stationary portion 136 in some embodiments. The base 128 may house a number of electrical components that are utilized in satellite tracking and communication functions. As just one example, the stationary portion 136 may include, without limitation, a beacon receiver, one or more controllers and/or other processing units, a signal amplifier, an RF switch, directional couplers, and the like. In some embodiments, the stationary portion 136 may include a front panel 137 that includes one or more input devices, such as a keypad, dials, touchscreen, and/or other devices, that enable users to control operations of the support structure 104 and/or antenna 102. The stationary portion 136 may also include one or more heat sinks and/or fans. The rotatable portion 138 may include an antenna interface that may communicate with the feed horn assembly 108 and/or a GPS receiver that may determine the position of the antenna 102 in order to properly adjust the azimuth and elevation angles of the antenna for tracking satellites.

Figure 1H:
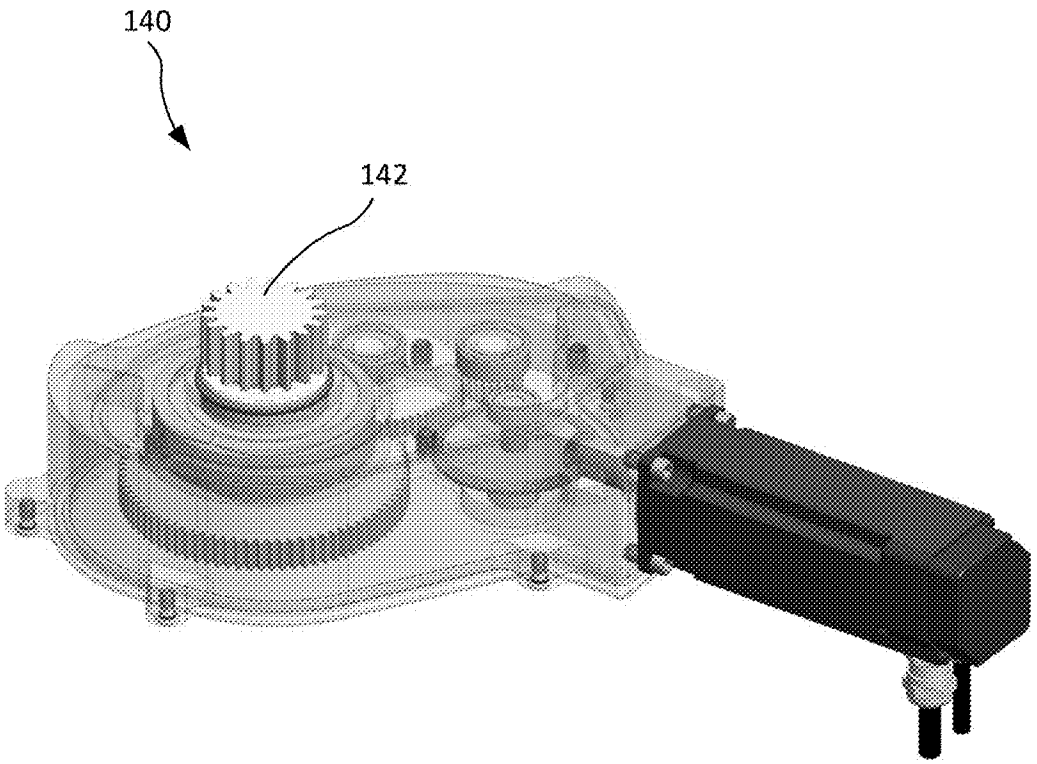
FIG. 1H illustrates a drive gear of an antenna support structure according to an embodiment of the present invention.
Figure 1I:
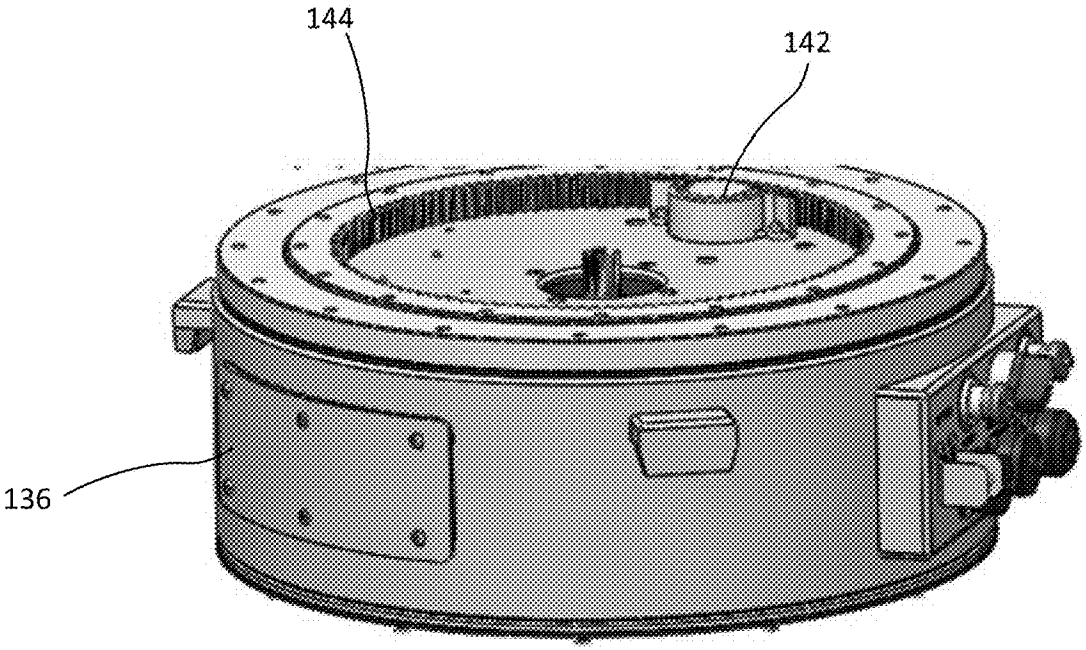
FIG. 1I illustrates an azimuthal gear system of an antenna support structure according to an embodiment of the present invention.

The rotatable portion 138 may rotate relative to the stationary portion 136 to adjust an azimuth position of the antenna 102. For example, the rotatable portion 138 may be coupled with an azimuth actuator 140 that selectively rotates the rotatable portion 138 to adjust the azimuth position of the antenna 102 to enable the antenna 102 to track a moving satellite. For example, the azimuth actuator 140 may include a motor and gearbox assembly that may be disposed within the stationary portion 136. A drive gear 142 (shown in FIG. 1H) may protrude from an upper surface of the azimuth actuator 140 and stationary portion 136, and may engage with an internal gear 144 that may be coupled with a bottom of the rotatable portion 138 as shown in FIG. 1I. Rotation of the drive gear 142 may cause a corresponding angular adjustment of the azimuth position of the rotatable portion 138 (and antenna 102). It will be appreciated that the design of azimuth actuator 140 shown here is just one example of an actuator for controlling the azimuth position of the antenna 102 and that other designs may be used in various embodiments.

To facilitate electrical connections between the stationary portion 136 and rotatable portion 138 during rotation of the rotatable support 138, the base 128 may include a slip ring 146. For example, the slip ring 146 may include a stationary drum 148 that may be positioned against a rotary drum 150. As the rotary drum 150 turns during rotation of the antenna 102, electric current and/or other signals may be conducted between the stationary portion 136 and rotatable portion 138 via the contact between the rotary drum 150 and stationary drum 148. Wires may extend from the rotary drum 150 to any number of components within the rotatable portion 138. The rotatable portion 138 may include a fixed support 152 that extends into and is coupled with the stationary portion 136. The fixed support 152 may help stabilize the rotatable portion 138 and support arms 112. A top end of the fixed support 152 may be received within and/or otherwise coupled with a rotary joint 154, which may include one or more bearing components to help facilitate rotation of the rotatable portion 136 about the fixed support 152.

The design of base 128 may enable RF signals, high current, and/or low current signals to be transferred through the rotatable portion 138 in a small/lightweight package to support continual azimuth rotation during satellite tracking. In tracking antennas that have elevation over azimuth arrangements, electrical and RF connections must rotate as the antenna rotates. Some systems limit the travel so that cables do not get wrapped around structure during rotation, but continual rotation is desired to support LEO/MEO satellite tracking. Continual rotation requires electrical signals to be routed through rotating equipment such as slip rings and rotary joints. The present base design combines a number of small components to create an assembly that fits into a very small package. The small volume enables the base 128 of the satellite tracking antenna to remain small, lightweight and easy to setup/teardown for tactical use.

The illustrated embodiment combines the slip ring 146 and rotary joint 154 together enables such rotation packed within a very small package. The rotary joint 154 may receive one or more RF channels and may be mounted vertically above the slip ring 146 having one or more electrical channels. The slip ring may be a through bore slip ring that enables the RF cables to be routed through the bore of the slip ring 146 and connected below. The rotary joint 154 may be mounted directly with a mounting flange to the rotatable portion 138, and the slip ring 146 may be mounted with a slip ring drive flange. The slip ring rotating wires pass through holes in the drive flange and may terminate at connectors on the rotating portion 138. The slip ring 146 may be mounted directly to the stationary portion 136, and the rotary joint 154 may have a stationary connection that passes through the bore of the slip ring 146 and into the stationary portion 136 to ground the slip ring 146 and keep the stationary RF cables from rotating during rotation of the rotatable portion 138.

The insertion of the rotary joint 154 output cabling into the through bore of the slip ring 146 may enable the slip ring 146 and rotary joint 154 to be coaxial and take up significantly less space than if they were mounted side by side. The smaller package enables the tracking antenna support structure 104 to be smaller and lighter which makes the support structure 104 easier to transport and setup/teardown.

Figure 1J:
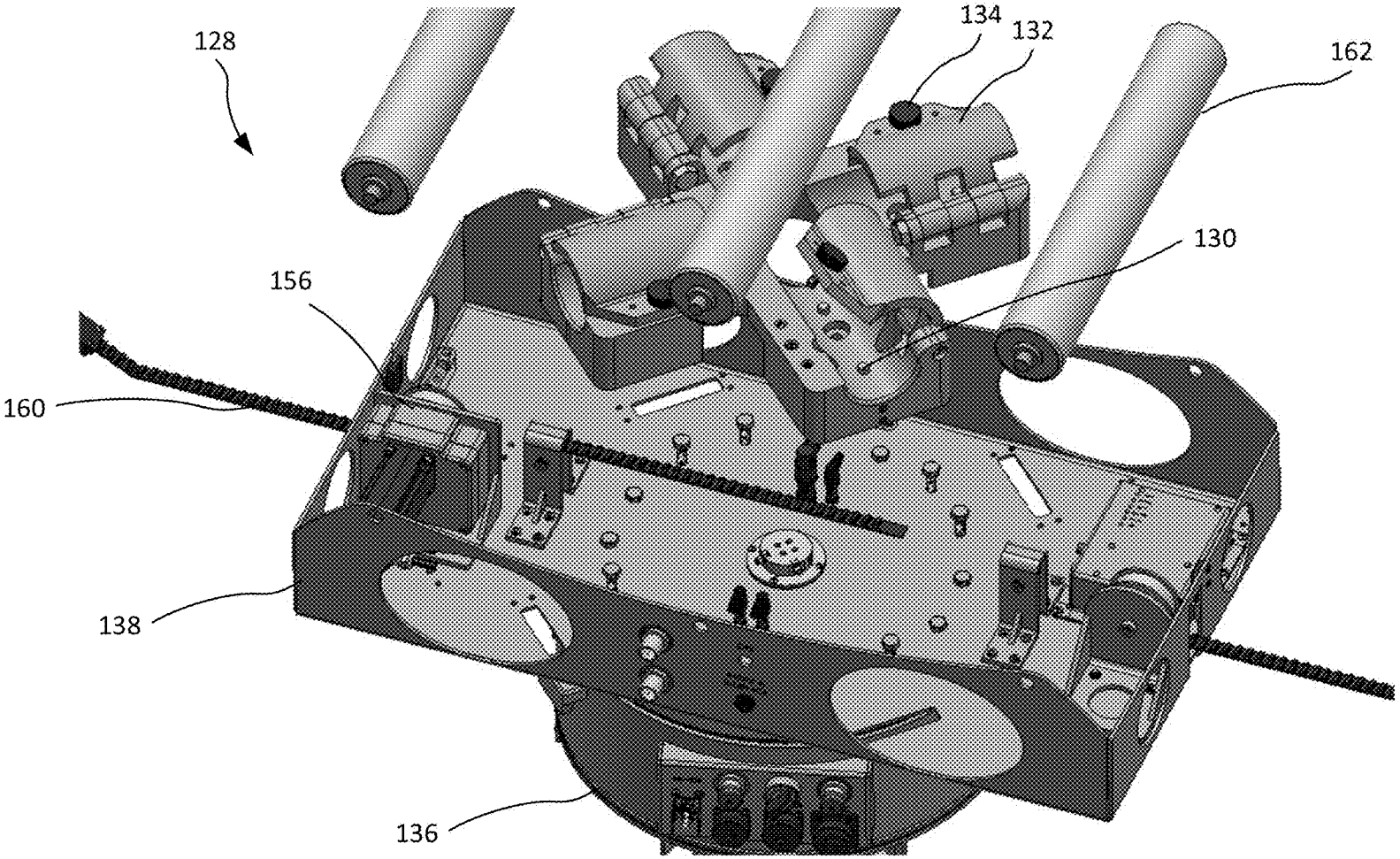
FIG. 1J illustrates an elevation actuator of an antenna support structure according to an embodiment of the present invention.
Figure 1K:
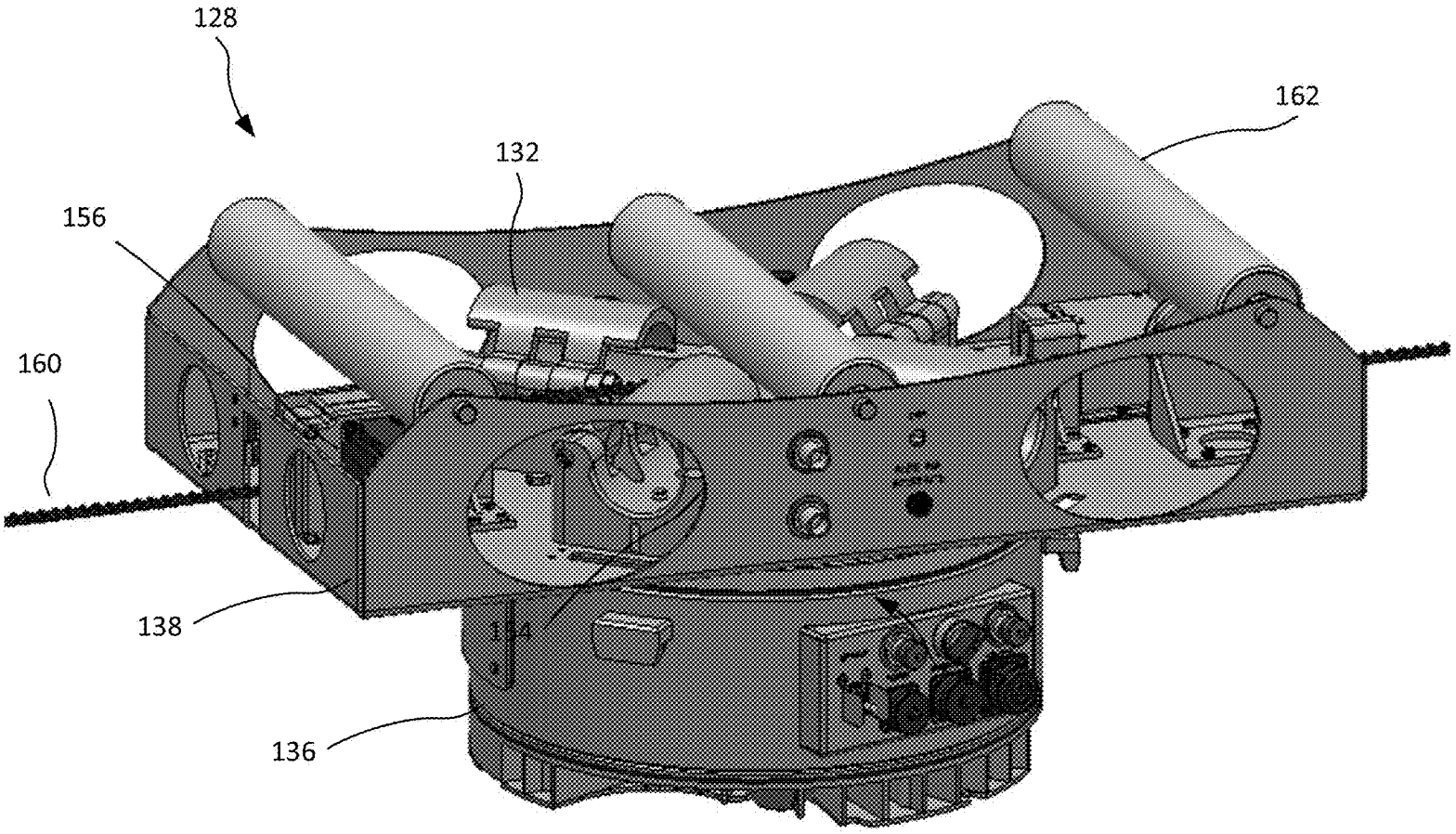
FIG. 1K illustrates an elevation actuator of an antenna support structure according to an embodiment of the present invention.
Figure 1L:
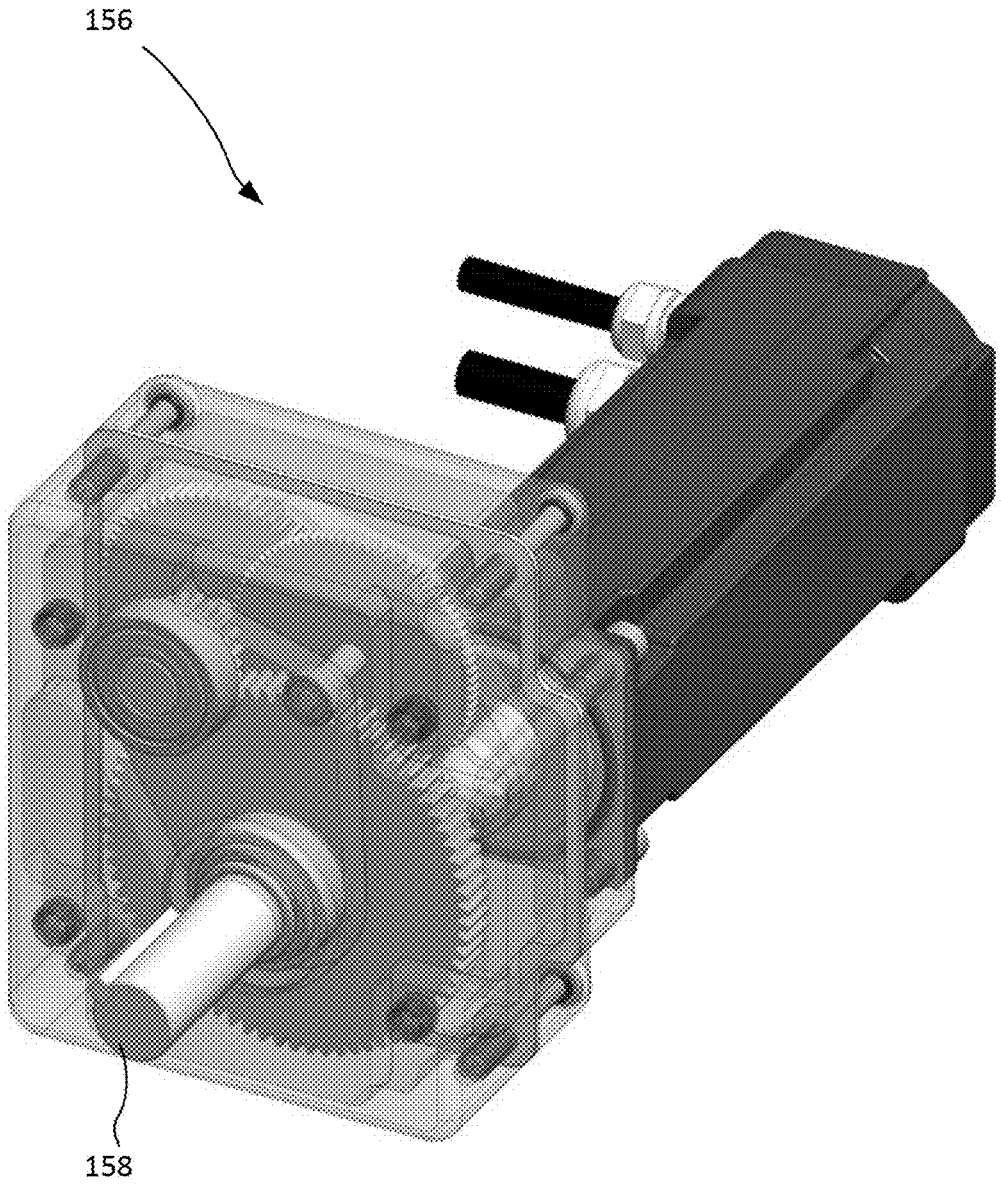
FIG. 1L illustrates an elevation actuator of an antenna support structure according to an embodiment of the present invention.

As shown in FIGS. 1J-1L, the rotatable portion 138 may also include an elevation actuator 156, which may be used to adjust an elevation angle of the inflatable antenna 102. For example, the elevation actuator 156 may include a motor and gearbox assembly that may be disposed within the rotatable portion 138. A drive gear 158 (shown in FIG. 1L) may protrude from a lateral surface of the elevation actuator 156 and rotatable portion 138, and may engage with a timing belt 160 that may be coupled with an outer surface of the antenna 102. As just one example, the timing belt 160 may be detachably coupled with the outer surface of the antenna 102 for greater packability. For example, a distal end of the timing belt may include a connector, such as a clip, that may engage with a corresponding connector of the antenna 102. Rotation of the drive gear 158 may move the timing belt 160 to cause a corresponding angular adjustment of the elevation position of the antenna 102. It will be appreciated that the design of elevation actuator 156 shown here is just one example of an actuator for controlling the elevation position of the antenna 102 and that other designs may be used in various embodiments.

The inclusion of both the azimuth and elevation actuators may enable the support structure 104 to be used to support and move the antenna 102 to track LEO, MEO, and/or GEO satellites. Control software may take measurements from one or more elevation, azimuth, and/or other sensors (such as inertial measurement units (IMUs), GPS sensors, etc.), along with signals and/or other data indicating the position of one or more satellites and use this data to control actuation of the azimuth and elevation actuators to move the antenna 102 to track and/or otherwise point at a given satellite. The azimuth and elevation actuators may be activated simultaneously or individually in some embodiments.

Antenna software may integrate the antenna setup, system diagnostics, satellite selection, satellite orbit propagation, satellite track selection, antenna feedback and control, and/or RF tracking control, and may provide a user interface with a web GUI. The software may be hosted on a single board computer and may be displayed on any connected terminal that has a TCP/IP connection and web browser. A control loop may control the azimuth and elevation motors during satellite tracking and may be uniquely configured in a velocity loop adjusted by a PID controller in position mode. Satellite tracking follows a standard set of processes to calculate look angles for the antenna for each satellite pass. The steps are: setup antenna and verify location and time using GPS or manual input, choose satellite from pre-populated list or input satellite ephemeris data from a two line element set, use the propagation tool to calculate satellite orbit and antenna look angles for upcoming satellite passes. After the software calculates look angles for each second of the satellite pass the controller estimates angles for smaller time segments in milliseconds and calculates velocity required between each step to maintain contact with the satellite. The calculated velocity is used to provide the initial motor command during a satellite pass and adjusted by using position error during the satellite pass. Position error is calculated by subtracting the required position (calculated pointing angles) from the actual measured position (provided by sensors). The position error is passed through a PID control algorithm then used to adjust the velocity command for each time. This method enables the user to adjust the track for timing errors, ephemeris errors, position offsets and allows for closed loop RF tracking as well. The software may drive spherical antenna control for auto-tracking with a secure interface via web GUI. U.S. Pat. No. 7,764,243 describes an antenna positioning system for a spherical antenna, which is incorporated by reference for all purposes.

The software may provide a single panel user interface that enables the user to setup the terminal, troubleshoot and command the terminal to perform satellite tracking and auto-pointing as well as exploit imagery and disseminate when available. The software may contain all of the controls required to read in sensor data and command motors, RF equipment, modems, decoders and network gear while being hosted on a single board computer and interfaced via web server application. The antenna setup portion may enable use of precision timing sources, GPS, azimuth and elevation sensors and enables antenna leveling as well as verify system functionality with built in test features to verify RF chain, motors, computers, etc. The software may contain a specialized control algorithm to control the azimuth and elevation motors that allows for smooth motor control during a pass and also enables adjustments to be made during the track to account for time offset, ephemeris errors, antenna offset, and RF tracking.

In some embodiments, the base 128 may include a number of rollers 162 that may help to stabilize and support the weight of the antenna 102, as well as facilitate adjustments to the elevation angle of the antenna 102. For example, one or more rollers 162 may be positioned on an upward facing surface of the base 128 and/or one or more of the plurality of support arms 112. As illustrated, the rollers 162 are positioned such that a top surface of each roller 162 extends above a top surface of the rotatable portion 138 of the base 128. In some embodiments, rotational axes of multiple rollers 162 may be aligned along an actuate path that mimics a circumference of the antenna 102, such that the top surfaces of the various rollers 162 may simultaneously in contact with the outer surface of the antenna 102 to help support the load. As the elevation angle of the antenna 102 is adjusted, the rollers 162 may act as bearings to help support the weight of the antenna 102 while enabling rotation of the antenna 102 without adding significant friction to the system, which may enable a less powerful elevation actuator 156 to be used in some embodiments.

Figure 1M:
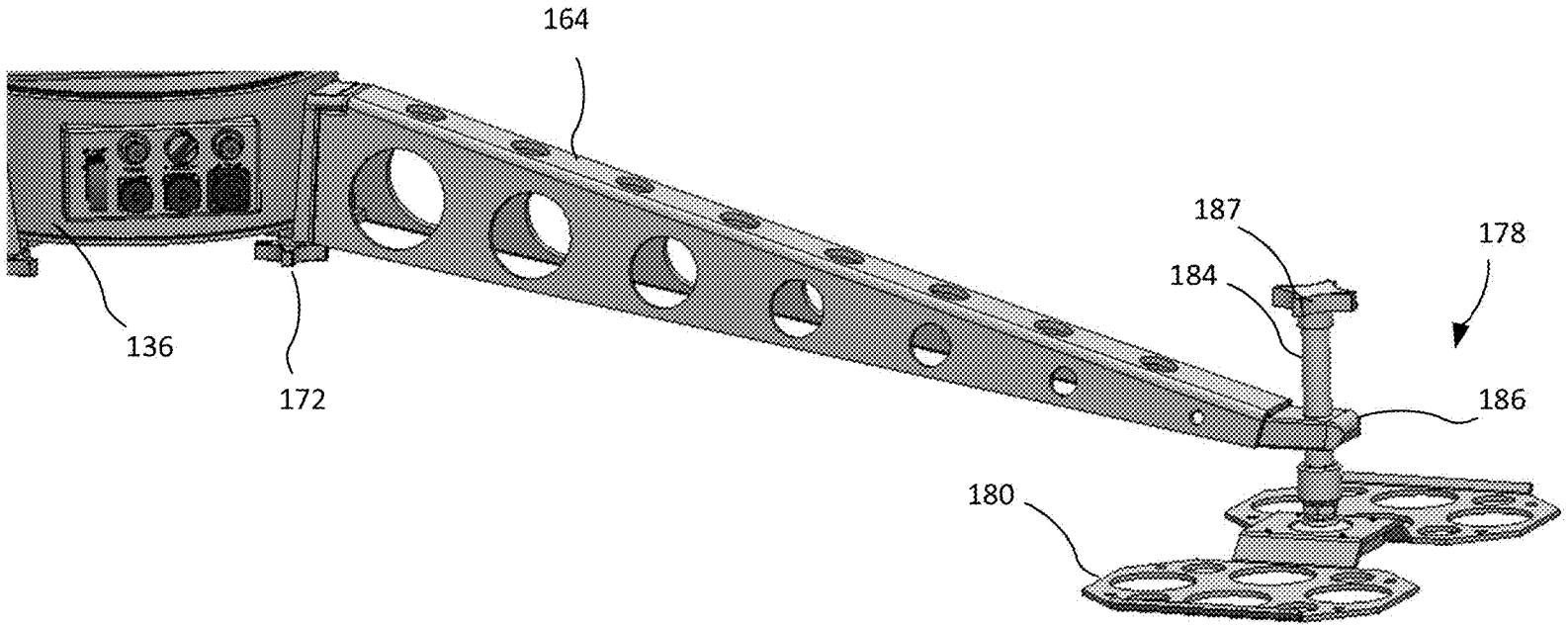
FIG. 1M illustrates legs of a base of an antenna support structure according to an embodiment of the present invention.
Figure 1N:
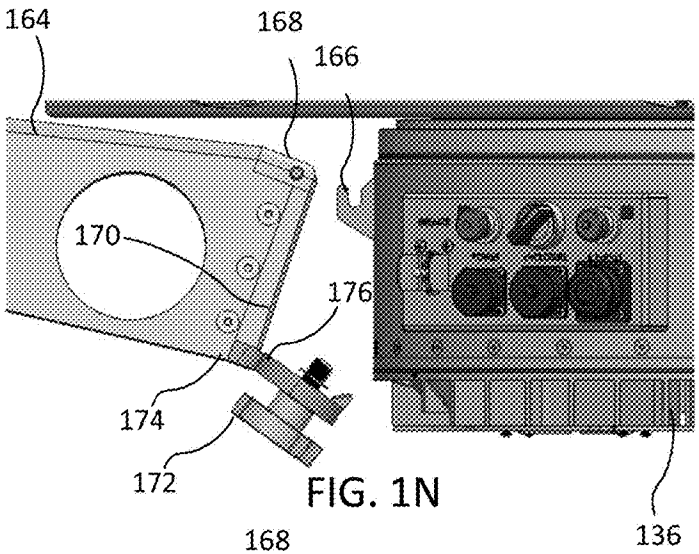
FIG. 1N-1Q illustrate a connection system for coupling legs with a base of an antenna support structure according to an embodiment of the present invention.
Figure 1O:
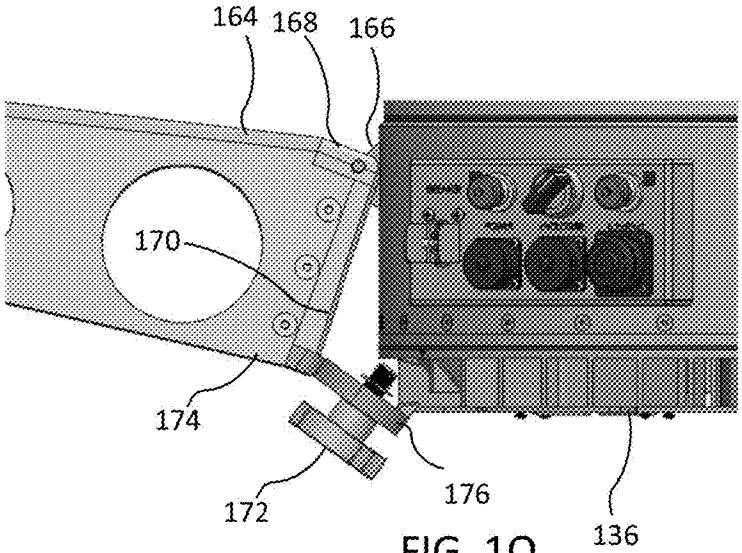
Figure 1P:
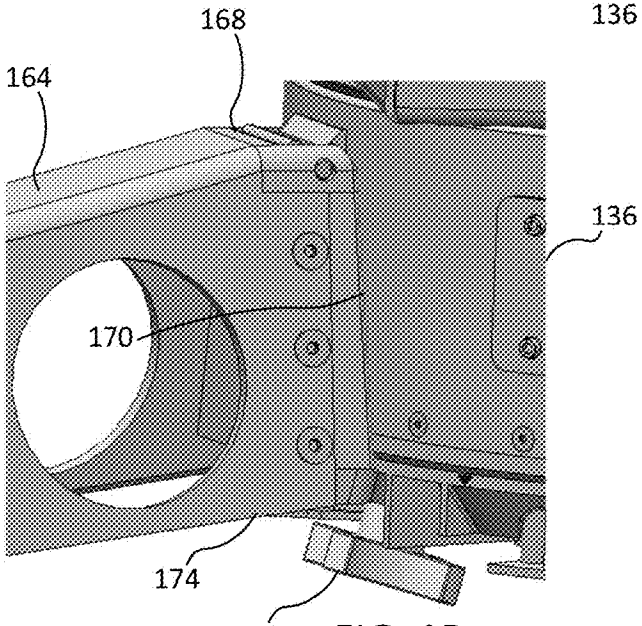
Figure 1Q:
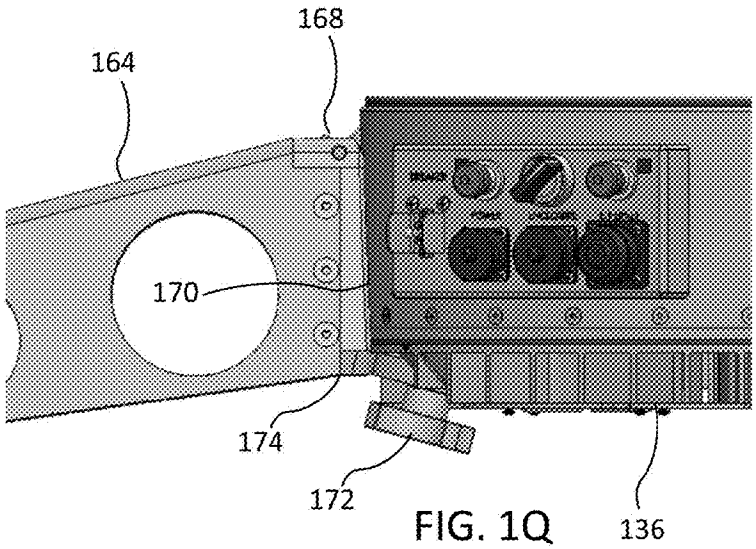

As best illustrated in FIG. 1M, the base 128 may include a number of legs 164 (typically at least three) that extend downward and/or outward from the base 128 and provide a stable foundation for the support structure 104 and antenna 102. The legs 164 may be coupled with the stationary portion 136 of the base 128. The legs 164 may be single pieces and/or made up of multiple segments that may be coupled together. As illustrated, each leg 164 is a single piece, which may include a number of cutouts that may help reduce the weight of the leg 164 for easier transport. As with the support arms 112, each leg 164 may be coupled with the base 128 without the use of tools. FIGS. 1N-1Q illustrate one embodiment of a connection system used to couple each leg 164 with the base 128. For example, the stationary portion 136 of the base 128 may include a hook 166 at each leg-attachment position. To secure the leg 164 onto the base 128, a base of the leg 164 may be tilted upward as shown in FIG. 1N, and the hook 166 may be inserted through a slot formed through an interior surface of the leg 164. The hook 166 may engage a lip formed at the edge of the slot to secure a top surface 168 of the leg 164 with the base 128 as shown in FIG. 1O. The base of the leg 164 may be lowered such that a lateral surface 170 of the leg 164 may be flush with or substantially parallel with an outer surface of the base 128 as shown in FIG. 1P. To further secure the leg 164 to the base 128, a fastener 172, such as a threaded knob, may be inserted into and tightened within a receptacle formed within the base 128 as shown in FIG. 1Q. For example, a flange 176 may be coupled with and extend from a bottom surface 174 and/or the lateral surface 170 of the leg. The fastener 172 may be inserted through the flange 176 and into the receptacle of the base 128 to secure the leg 164 and base 128 together. Such a design may enable users to quickly deploy and pack the legs 164 and base 128 without the use of any tools.

Figure 1R:
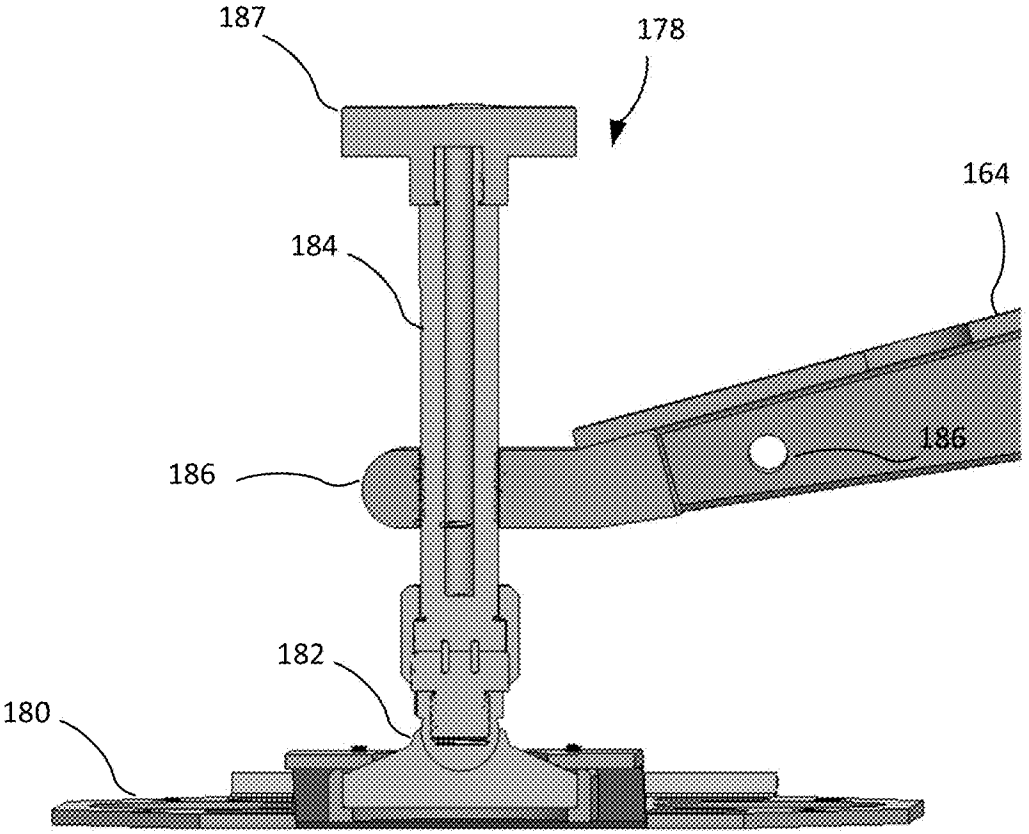
FIG. 1R illustrates a leveling support of an antenna support structure according to an embodiment of the present invention.

In some embodiments, some or all of the legs 164 may include a leveling support 178. For example, as best illustrated in FIG. 1R, the leveling support 178 may include a foot 180 that is positionable against the floor, ground, and/or other support surface. The foot 180 may be coupled with a swivel bearing 182 that may enable the foot 180 to pivot relative to the leg 164 to enable the leveling support 178 to adapt the support structure 104 to uneven terrain. The swivel bearing 182 may be coupled with a leveling screw 184, which may extend through a base 186 of the leg 164. For example, threads of the leveling screw 184 may be received within a threaded aperture formed in the base 186 of the leg 164. A graspable feature 187, such as a knob, may be provided at the top end of the leveling screw 184 that enables a user to adjust a height of the base 186 of the leg 164 to level the support structure 104. For example, the user may grasp the graspable feature 187 and rotate the leveling screw 184 in a first direction to raise the base 186 of the leg 164 and in a second direction to lower the base 186 of the leg 164.

Figure 1S:
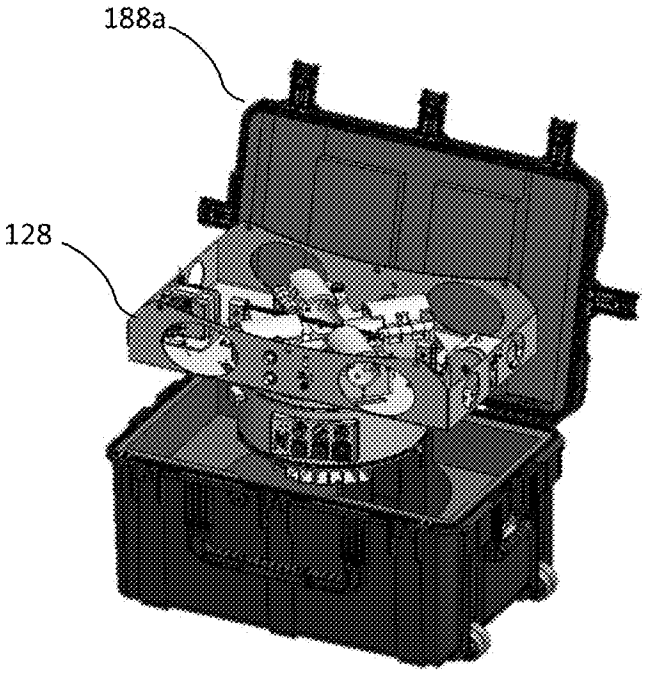
FIG. 1S illustrates a packing configuration for an antenna support structure according to an embodiment of the present invention.
Figure 1T:
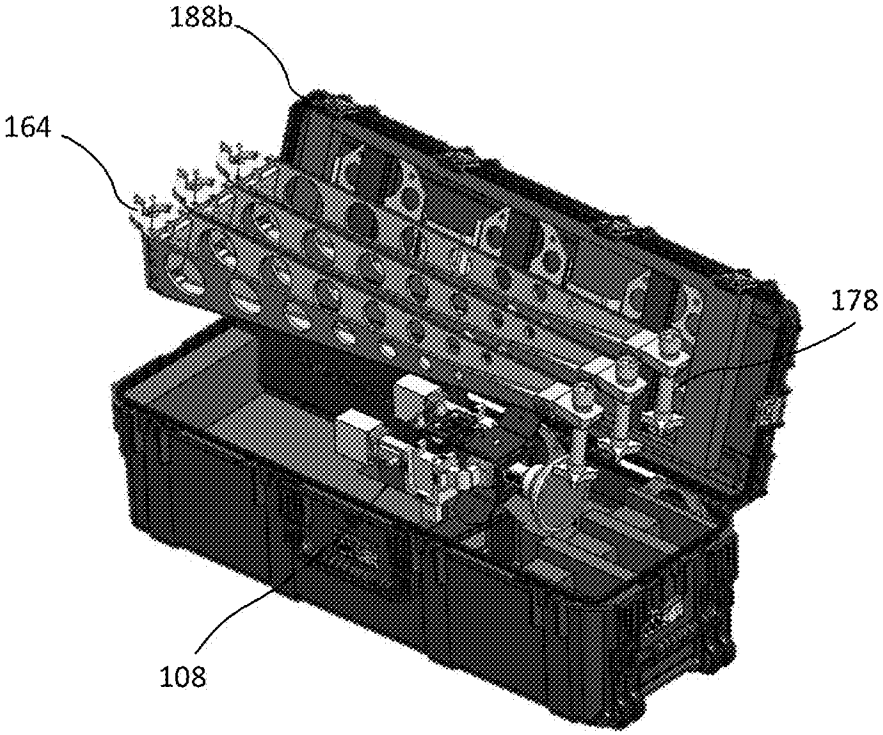
FIG. 1T illustrates a packing configuration for an antenna support structure according to an embodiment of the present invention.
Figure 1U:
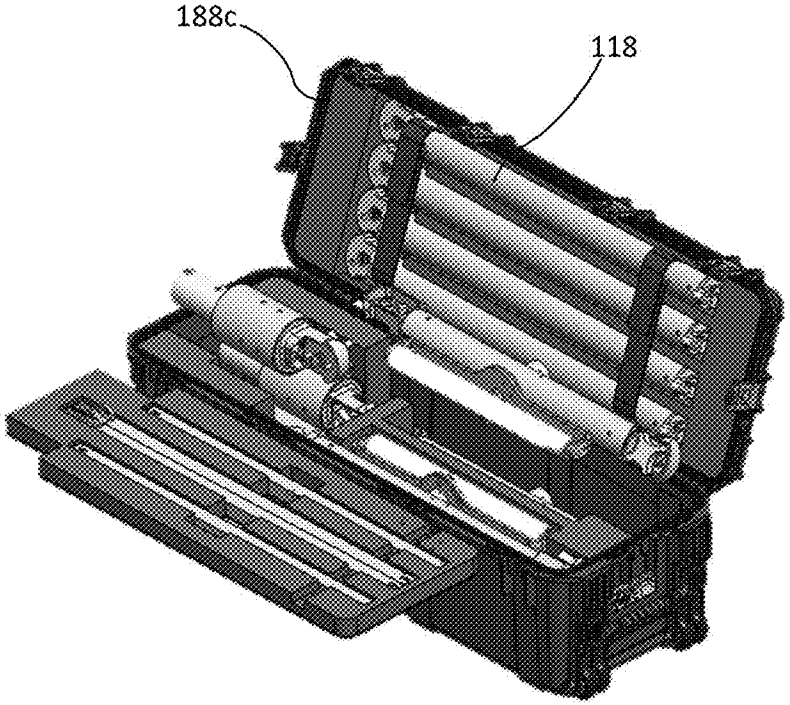
FIG. 1U illustrates a packing configuration for an antenna support structure according to an embodiment of the present invention.
Figure 1V:
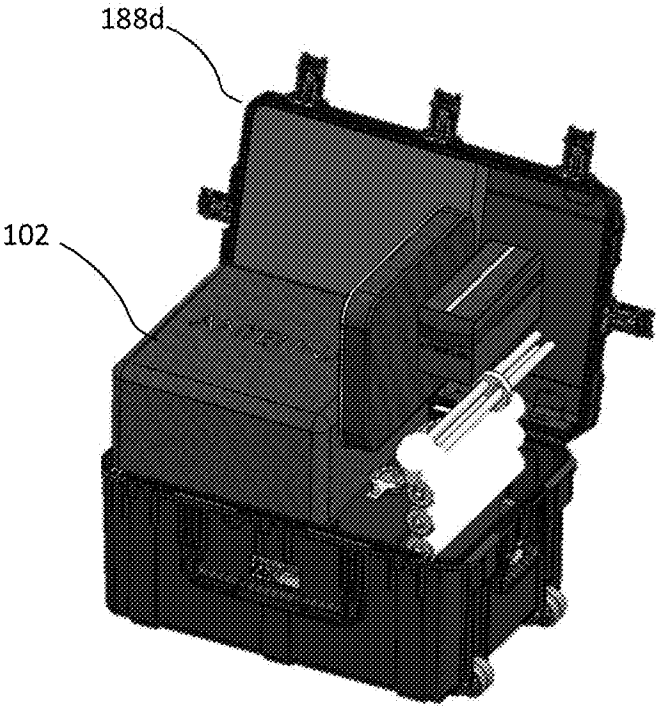
FIG. 1V illustrates a packing configuration for an antenna support structure according to an embodiment of the present invention

As indicated above, the tracking support structure 104 may be packable into one or more handheld storage containers between deployments. FIGS. 1S-1V illustrate one configuration for packing the support structure 104 according to an embodiment of the invention. For example, as shown in FIG. 1S, the base 128, with legs 164 and support arms 112 disengaged, may be placed in a first case 188. The legs 164, leveling supports 178, and the feed horn assembly 108 may be packed into a second case 188*b* as shown in FIG. 1T. The support arms 112 and/or segments 118 thereof may be stored in a third case 188*c* as shown in FIG. 1U. The deflated antenna 102 may be stored in a fourth case 188*d* as shown in FIG. 1V. Each case 188 may include one or more handles 190 and may include wheels 192, which may enable a single user to carry, pull, push, and/or otherwise transport the case 188. While shown with four cases 188, it will be appreciated that the antenna 102 and/or tracking support structure 104 may be packed into any number of cases 188 and/or other storage units. Additionally, other configurations of contents for the various cases 188 are possible in various embodiments. The configuration described above is merely illustrative of one of a number of permutations of storage configurations.

Figure 2:
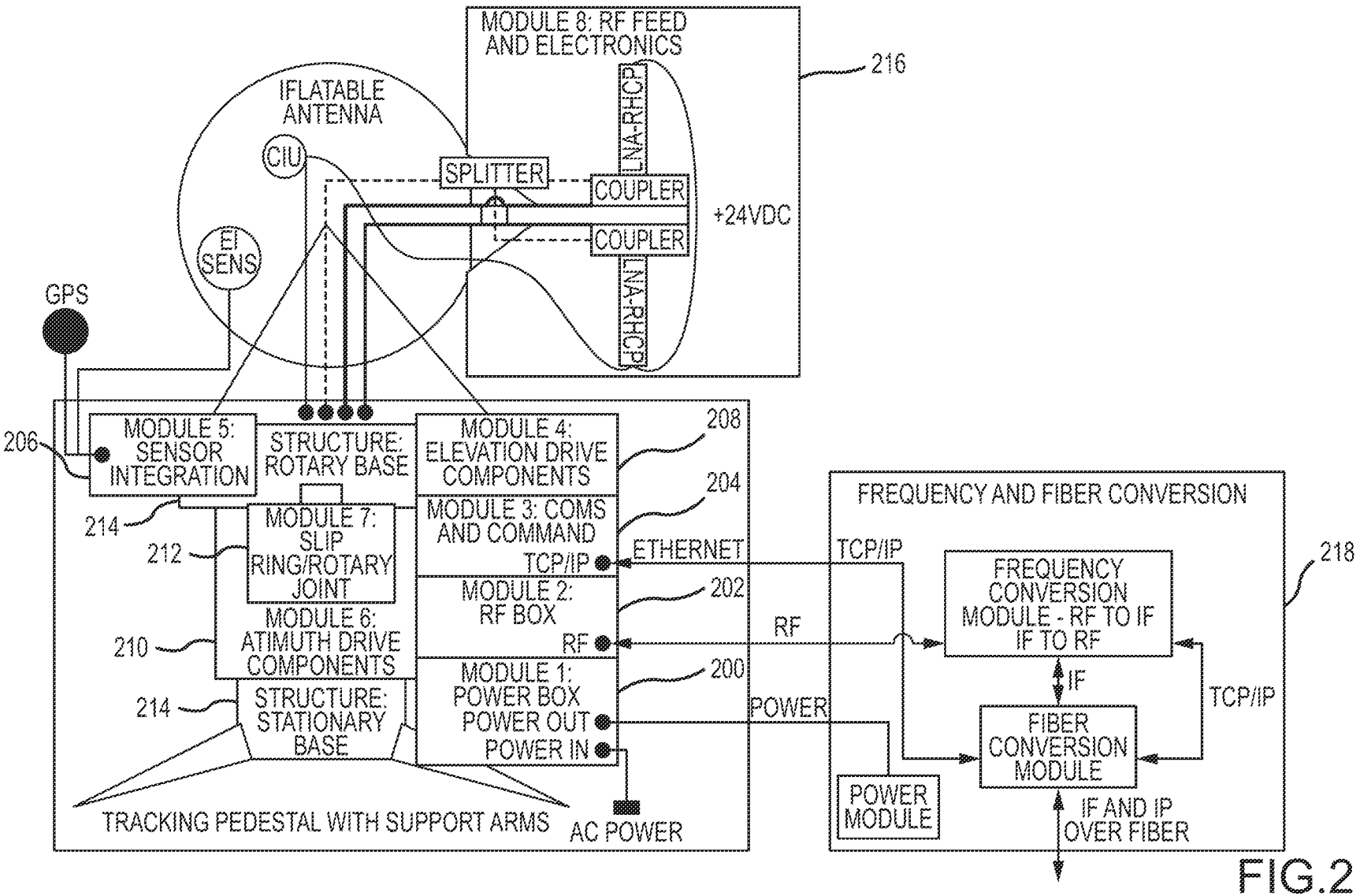
FIG. 2 illustrates a modular design of a packable antenna assembly according to an embodiment of the present invention.

In some embodiments, the support structure 104 may be designed to be easily repaired and/or modified for different mission requirements. For example, the support structure 104 may avoid having components integrated into a base 128 that is difficult to assemble, troubleshoot, and/or repair, which may make field replacement of components nearly impossible. Embodiments of support structures 104 may have the various components arranged in a fashion that enables the components to be connected/disconnected easily and provides for interfaces to support different arrangements so capability can be increased or decreased depending on mission need. The design may have modules that incorporate individual interfaces and housings that support removal and replacement with spare parts so that lower level components such as circuit boards, internal cables, and/or sensors do not have to be probed during troubleshooting investigation. The modules may contain indicators and built in test capability to help the user determine where problems may have occurred. For example, as shown in FIG. 2, the design may include a power module 200, an RF component module 202, a communications and control module 204, a sensor integration module 206, an elevation drive components module 208, an azimuth drive components module 210, a rotary electrical and RF connections module 212, a structural support module 214, an RF feed and electronics module 216, and/or a frequency conversion and fiber conversion module 218. The power module 200 may contain equipment that converts AC power to DC power required by other modules. The RF component module 202 may include frequency conversion equipment, RF switches, a spectrum analyzer, and/or RF cables. The communications and control module 204 may contain computing equipment and interfaces required for serial and digital communication to other components/modules. The elevation and azimuth drive modules 208, 210 contain motor controllers, motors and gearboxes required to create motion in azimuth and elevation axes as described above. The sensor integration module 206 may contain equipment required to interface with GPS and IMU sensors. The RF feed module 216 may contain the RF Feed and RF amplifiers.

The modules used in this embodiment of the tracking support structure may enable the support structure to be easily customized for various mission requirements and support simple troubleshooting and quick replacement of damaged modules. Modules can be purchased as spare components and can be replaced in the field by personnel with little or no training. Such designs may integrate electronics into one large box or other housing, which creates fewer external connections. In an alternative embodiment, the architecture for the tracking support structure can be integrated with components designed to be mounted in the fewest housings as possible or modular with multiple housings and interfaces.

Figure 3:
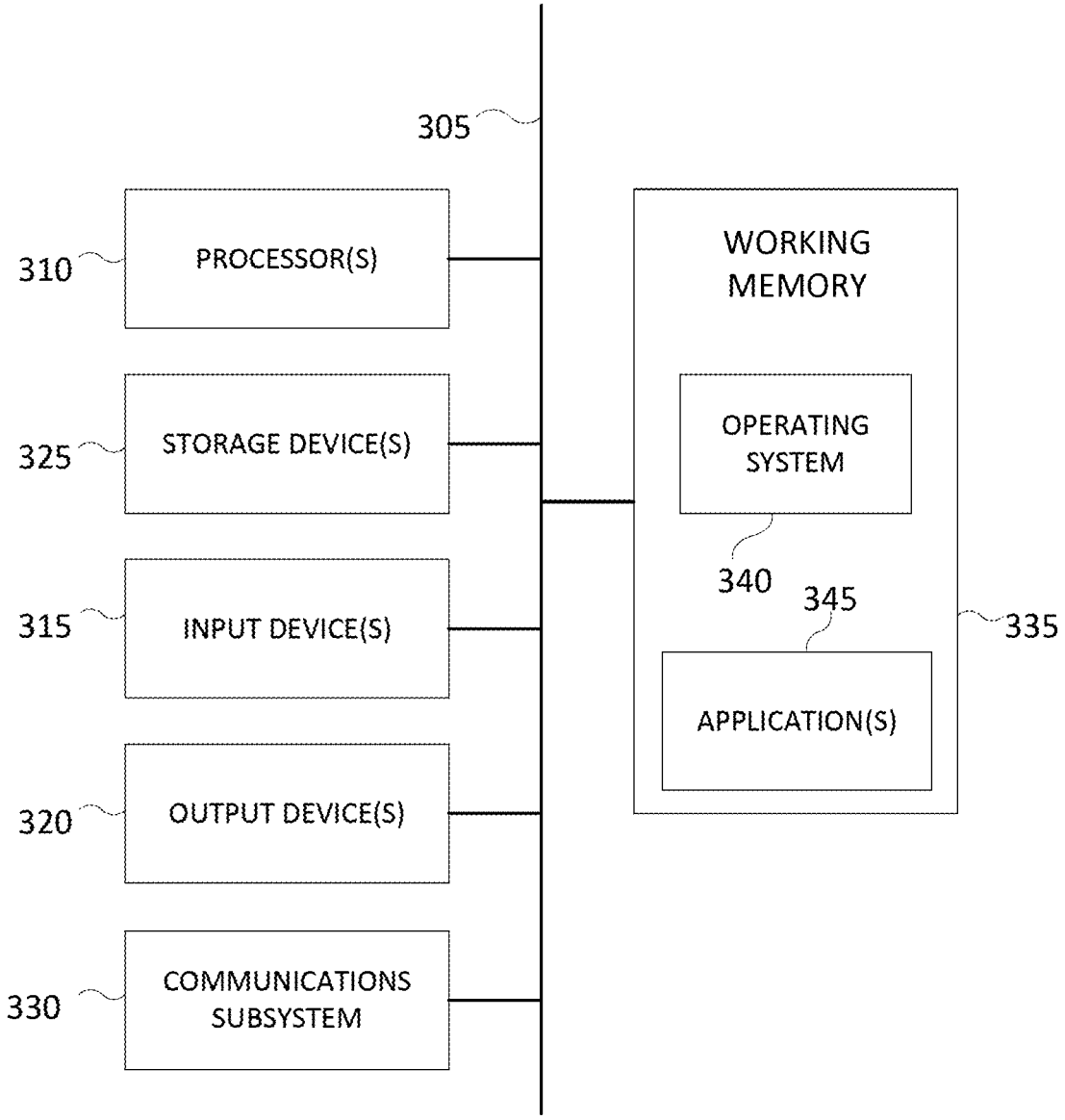
FIG. 3 is a block diagram of a computer system according to one embodiment of the present invention.

A computer system as illustrated in FIG. 3 may be incorporated as part of the previously described computerized devices. For example, computer system 300 can represent some of the components of computing devices, such as the various processors and actuators, and/or other computing devices described herein. FIG. 3 provides a schematic illustration of one embodiment of a computer system 300 that can perform the methods provided by various other embodiments, as described herein. FIG. 3 is meant only to provide a generalized illustration of various components, any or all of which may be utilized as appropriate. FIG. 3, therefore, broadly illustrates how individual system elements may be implemented in a relatively separated or relatively more integrated manner.

The computer system 300 is shown comprising hardware elements that can be electrically coupled via a bus 305 (or may otherwise be in communication, as appropriate). The hardware elements may include a processing unit 310, including without limitation one or more processors, such as one or more special-purpose processors (such as digital signal processing chips, graphics acceleration processors, and/or the like); one or more input devices 315, which can include without limitation a keyboard, a touchscreen, receiver, a motion sensor, a camera, a smartcard reader, a contactless media reader, and/or the like; and one or more output devices 320, which can include without limitation a display device, a speaker, a printer, a writing module, and/or the like.

The computer system 300 may further include (and/or be in communication with) one or more non-transitory storage devices 325, which can comprise, without limitation, local and/or network accessible storage, and/or can include, without limitation, a disk drive, a drive array, an optical storage device, a solid-state storage device such as a random access memory ("RAM") and/or a read-only memory ("ROM"), which can be programmable, flash-updateable and/or the like. Such storage devices may be configured to implement any appropriate data stores, including without limitation, various file systems, database structures, and/or the like.

The computer system 300 might also include a communication interface 330, which can include without limitation a modem, a network card (wireless or wired), an infrared communication device, a wireless communication device and/or chipset (such as a Bluetooth™ device, an 502.11 device, a Wi-Fi device, a WiMAX device, an NFC device, cellular communication facilities, etc.), and/or similar communication interfaces. The communication interface 330 may permit data to be exchanged with a network (such as the network described below, to name one example), other computer systems, and/or any other devices described herein. In many embodiments, the computer system 300 will further comprise a non-transitory working memory 335, which can include a RAM or ROM device, as described above.

The computer system 300 also can comprise software elements, shown as being currently located within the working memory 335, including an operating system 340, device drivers, executable libraries, and/or other code, such as one or more application programs 345, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such special/specific purpose code and/or instructions can be used to configure and/or adapt a computing device to a special purpose computer that is configured to perform one or more operations in accordance with the described methods.

A set of these instructions and/or code might be stored on a computer-readable storage medium, such as the storage device(s) 325 described above. In some cases, the storage medium might be incorporated within a computer system, such as computer system 300. In other embodiments, the storage medium might be separate from a computer system (e.g., a removable medium, such as a compact disc), and/or provided in an installation package, such that the storage medium can be used to program, configure and/or adapt a special purpose computer with the instructions/code stored thereon. These instructions might take the form of executable code, which is executable by the computer system 300 and/or might take the form of source and/or installable code, which, upon compilation and/or installation on the computer system 300 (e.g., using any of a variety of available compilers, installation programs, compression/decompression utilities, etc.) then takes the form of executable code.

Substantial variations may be made in accordance with specific requirements. For example, customized hardware might also be used, and/or particular elements might be implemented in hardware, software (including portable software, such as applets, etc.), or both. Moreover, hardware and/or software components that provide certain functionality can comprise a dedicated system (having specialized components) or may be part of a more generic system. For example, a risk management engine configured to provide some or all of the features described herein relating to the risk profiling and/or distribution can comprise hardware and/or software that is specialized (e.g., an application-specific integrated circuit (ASIC), a software method, etc.) or generic (e.g., processing unit 310, applications 345, etc.) Further, connection to other computing devices such as network input/output devices may be employed.

Some embodiments may employ a computer system (such as the computer system 300) to perform methods in accordance with the disclosure. For example, some or all of the procedures of the described methods may be performed by the computer system 300 in response to processing unit 310 executing one or more sequences of one or more instructions (which might be incorporated into the operating system 340 and/or other code, such as an application program 345) contained in the working memory 335. Such instructions may be read into the working memory 335 from another computer-readable medium, such as one or more of the storage device(s) 325. Merely by way of example, execution of the sequences of instructions contained in the working memory 335 might cause the processing unit 310 to perform one or more procedures of the methods described herein.

The terms "machine-readable medium" and "computer-readable medium," as used herein, refer to any medium that participates in providing data that causes a machine to operate in a specific fashion. In an embodiment implemented using the computer system 300, various computer-readable media might be involved in providing instructions/code to processing unit 310 for execution and/or might be used to store and/or carry such instructions/code (e.g., as signals). In many implementations, a computer-readable medium is a physical and/or tangible storage medium. Such a medium may take many forms, including but not limited to, non-volatile media, volatile media, and transmission media. Non-volatile media include, for example, optical and/or magnetic disks, such as the storage device(s) 325. Volatile media include, without limitation, dynamic memory, such as the working memory 335. Transmission media include, without limitation, coaxial cables, copper wire, and fiber optics, including the wires that comprise the bus 305, as well as the various components of the communication interface 330 (and/or the media by which the communication interface 330 provides communication with other devices). Hence, transmission media can also take the form of waves (including without limitation radio, acoustic and/or light waves, such as those generated during radio-wave and infrared data communications).

Common forms of physical and/or tangible computer-readable media include, for example, a magnetic medium, optical medium, or any other physical medium with patterns of holes, a RAM, a PROM, EPROM, a FLASH-EPROM, any other memory chip or cartridge, a carrier wave as described hereinafter, or any other medium from which a computer can read instructions and/or code.

The communication interface 330 (and/or components thereof) generally will receive the signals, and the bus 305 then might carry the signals (and/or the data, instructions, etc. carried by the signals) to the working memory 335, from which the processor(s) 310 retrieves and executes the instructions. The instructions received by the working memory 335 may optionally be stored on a non-transitory storage device 325 either before or after execution by the processing unit 310.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. Furthermore, embodiments of the methods may be implemented by hardware, software, firmware, middleware, microcode, hardware description languages, or any combination thereof. When implemented in software, firmware, middleware, or microcode, the program code or code segments to perform the associated tasks may be stored in a computer-readable medium such as a storage medium. Processors may perform the associated tasks.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

The methods, systems, devices, graphs, and tables discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims. Additionally, the techniques discussed herein may provide differing results with different types of context awareness classifiers.

While illustrative and presently preferred embodiments of the disclosed systems, methods, and machine-readable media have been described in detail herein, it is to be understood that the inventive concepts may be otherwise variously embodied and employed, and that the appended claims are intended to be construed to include such variations, except as limited by the prior art.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein. As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. An inflatable tracking antenna assembly, comprising:

an inflatable antenna, the inflatable antenna being configurable in a packed configuration and a deployed configuration, wherein in the deployed configuration the inflatable antenna is generally spherical in shape, wherein the antenna comprises a differential global positioning satellite (GPS) connection;

an antenna support structure, comprising:

a plurality of support arms that couple with lateral sides of the inflatable antenna;

a base that is coupled with each of the plurality of support arms, wherein the base comprises an azimuth actuator that adjusts an azimuth position of the inflatable antenna based at least in part on a position information from the differential GPS connection and an elevation actuator that adjusts an elevation angle of the inflatable antenna;

a plurality of rollers disposed on an upward facing surface of the base, wherein:

rotational axes of the plurality of rollers are parallel with one another and are orthogonal to a direction of movement of the elevation actuator; and each of the plurality of rollers contacts an outer surface of the inflatable antenna; and a plurality of support legs that extend outward from the base.

2. The inflatable tracking antenna assembly of claim 1, wherein:

the inflatable antenna comprises at least two mating features;

each of the at least two mating features is disposed on a lateral side surface of the inflatable antenna; and a top end of each of the plurality of support arms comprises a corresponding mating feature that is engageable with a respective one of the at least two first mating features of the inflatable antenna.

3. The inflatable tracking antenna assembly of claim 1, further comprising:

a timing belt coupled with the inflatable antenna and the elevation actuator, wherein the elevation actuator maneuvers the timing belt to adjust the elevation angle of the inflatable antenna.

4. The inflatable tracking antenna assembly of claim 1, wherein:

the base comprises a stationary portion and a rotatable portion disposed atop the stationary portion; and the azimuth actuator rotates the rotatable portion relative to the stationary portion to adjust the azimuth position of the inflatable antenna.

5. The inflatable tracking antenna assembly of claim 4, further comprising:

a slip ring disposed between the stationary portion and the rotatable portion, the slip ring facilitating communication of electrical signals between the stationary portion and the rotatable portion.

6. The inflatable tracking antenna assembly of claim 1, wherein:

each of the plurality of support arms and each of the plurality of support legs is engageable and disengageable with the base without use of any tools.

7. A tracking support structure for an inflatable antenna, comprising:

a plurality of support arms that couple with lateral sides of the inflatable antenna;

a base that is coupled with each of the plurality of support arms, wherein the base comprises:

a stationary portion;

a rotatable portion disposed atop the stationary portion;

an azimuth actuator rotates the rotatable portion relative to the stationary portion to adjust an azimuth position of the inflatable antenna, wherein the azimuth actuator comprises:

an internal gear coupled with the rotatable portion; and a motor and gearbox assembly coupled with the stationary portion, the motor and gearbox assembly comprising a drive gear that is engaged with the internal gear; and an elevation actuator that adjusts an elevation angle of the inflatable antenna;

a plurality of rollers disposed on an upward facing surface of the base, wherein:

rotational axes of the plurality of rollers are parallel with one another and are orthogonal to a direction of movement of the elevation actuator; and each of the plurality of rollers contacts an outer surface of the inflatable antenna; and a plurality of support legs that extend outward from the base.

8. The tracking support structure for an inflatable antenna of claim 7, wherein:

each of the plurality of support arms is packable into a smaller form factor when the tracking base is disassembled.

9. The tracking support structure for an inflatable antenna of claim 7, wherein:

each of the plurality of support arms is formed from multiple segments.

10. The tracking support structure for an inflatable antenna of claim 9, wherein:

the segments are permanently coupled with and foldable relative to one another.

11. The tracking support structure for an inflatable antenna of claim 9, wherein:

at least some of the multiple segments are generally linear.

12. The tracking support structure for an inflatable antenna of claim 9, wherein:

the multiple segments are fully separable from one another.

13. The tracking support structure for an inflatable antenna of claim 7, further comprising:

a slip ring disposed between the stationary portion and the rotatable portion, the slip ring facilitating communication of electrical signals between the stationary portion and the rotatable portion.

14. A tracking support structure for an inflatable antenna, comprising:

a plurality of support arms that couple with lateral sides of the inflatable antenna;

a base that is coupled with each of the plurality of support arms, wherein the base comprises:

a stationary portion;

a rotatable portion disposed atop the stationary portion;

an azimuth actuator rotates that rotatable portion relative to the stationary portion to adjust an azimuth position of the inflatable antenna; and an elevation actuator that adjusts an elevation angle of the inflatable antenna;

a plurality of rollers disposed on an upward facing surface of the base, wherein:

rotational axes of the plurality of rollers are parallel with one another and are orthogonal to a direction of movement of the elevation actuator; and each of the plurality of rollers contacts an outer surface of the inflatable antenna; and a plurality of support legs that extend outward from the base, wherein each of the plurality of support legs comprises a leveling support that is pivotable relative to a respective one of the plurality of support legs.

15. The tracking support structure for an inflatable antenna of claim 14, wherein:

each of the plurality of support arms is curved.

16. The tracking support structure for an inflatable antenna of claim 14, wherein:

a top end of each of the plurality of support arms comprises mating features that are engageable with corresponding mating features of the inflatable antenna.

17. The tracking support structure for an inflatable antenna of claim 14, wherein:

the tracking support structure is packable into one or more handheld storage containers between deployment.

18. The inflatable tracking antenna assembly of claim 1, further comprising:

an additional plurality of rollers disposed on an upward facing surface of one or both of the base and one or more of the plurality of support arms, wherein:

rotational axes of the additional plurality of rollers are aligned along an actuate path that mimics a circumference of the inflatable antenna; and each of the additional plurality of rollers contacts an outer surface of the inflatable antenna.

* * * * *